US006790140B1

(12) United States Patent
Niwa

(10) Patent No.: US 6,790,140 B1
(45) Date of Patent: Sep. 14, 2004

(54) GAME MACHINE

(75) Inventor: Tsutomu Niwa, Tokyo (JP)

(73) Assignee: Aruze Corporation, Tokyo (JP)

( * ) Notice: Subject to any disclaimer, the term of this patent is extended or adjusted under 35 U.S.C. 154(b) by 228 days.

(21) Appl. No.: 09/641,709

(22) Filed: Aug. 21, 2000

(30) Foreign Application Priority Data

Aug. 23, 1999 (JP) ..... 11-235547

(51) Int. Cl.[7] ..... A63F 9/24
(52) U.S. Cl. ..... 463/20; 463/16
(58) Field of Search ..... 463/20; 273/143 R

(56) References Cited

U.S. PATENT DOCUMENTS

| | | | | | |
|---|---|---|---|---|---|
| 4,624,459 | A | * | 11/1986 | Kaufman | 273/143 R |
| 5,018,737 | A | * | 5/1991 | Okada | 273/143 R |
| 5,667,219 | A | * | 9/1997 | Ishibashi | 273/143 R |
| 5,695,188 | A | * | 12/1997 | Ishibashi | 273/143 R |
| 6,062,980 | A | * | 5/2000 | Luciano | 463/20 |
| 6,106,393 | A | * | 8/2000 | Sunaga et al. | 463/20 |
| 6,168,523 | B1 | * | 1/2001 | Piechowiak et al. | 463/26 |
| 6,270,409 | B1 | * | 8/2001 | Shuster | 463/20 |
| 6,302,790 | B1 | * | 10/2001 | Brossard | 463/20 |
| 6,375,567 | B1 | * | 4/2002 | Acres | 463/25 |

FOREIGN PATENT DOCUMENTS

| | | |
|---|---|---|
| EP | 0 443 738 A2 | 8/1991 |
| EP | 0 720 129 A1 | 7/1996 |

* cited by examiner

*Primary Examiner*—Teresa Walberg
*Assistant Examiner*—Julie Brocketti
(74) *Attorney, Agent, or Firm*—Venable LLP; Andrew C. Aitken

(57) ABSTRACT

A game machine comprises shift and display means for shifting and displaying a plurality of rows each having a plurality of symbol marks thereon; prize winning state determining means for determining a prize winning state based on random number lottery; stop control means for controlling the stop of the shift and display means to have a predetermined set of symbol marks shifted and displayed on the basis of the prize winning state determined by the prize winning state determining means; notifying means for notifying a game player of notifying information in notifying states including a current notifying state and subsequent notifying states following the current notifying state, while the game player is enjoying games including a current game and subsequent games following the current game; and subsequent notifying state determining means for determining and selecting in advance the subsequent notifying states on the basis of the current notifying state.

8 Claims, 44 Drawing Sheets

FIG.3
(a)
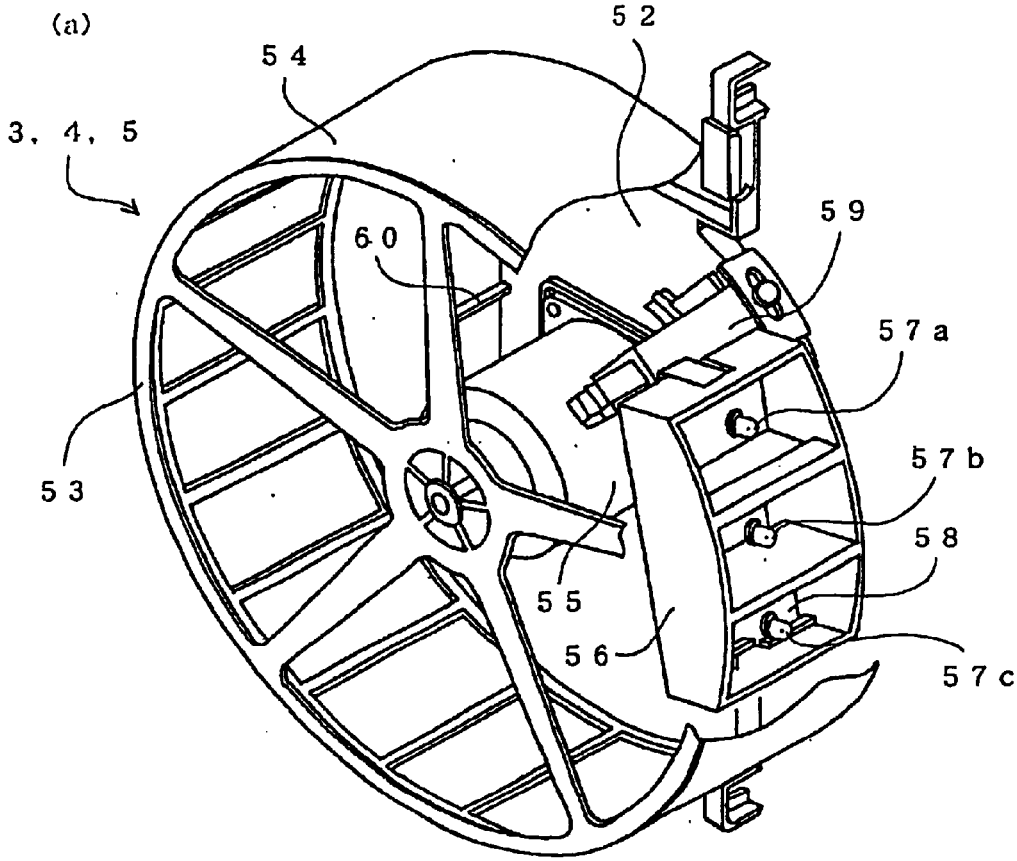
(b)
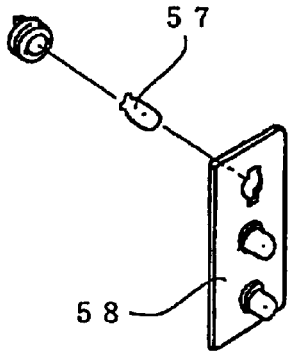

FIG.6

| PRIZE / NUMBER OF THE INSERTED GAME MEDALS | BIG | MEDIUM | SMALL | | |
|---|---|---|---|---|---|
| | BB | RB | PLUMS | BELLS | REPLAY |
| 1 | a1 | b1 | c1 | d1 | e1 |
| 2 | a2 | b2 | c2 | d2 | e2 |
| 3 | a3 | b3 | c3 | d3 | e3 |

FIG.7

| CODE No. | FIRST ROTATION REEL | SECOND ROTATION REEL | THIRD ROTATION REEL |
|---|---|---|---|
| 0 | A | E | B |
| 1 | G | C | H |
| 2 | F | D | F |
| 3 | C | G | E |
| 4 | F | D | F |
| 5 | A | A | A |
| 6 | D | E | E |
| 7 | C | G | F |
| 8 | G | D | D |
| 9 | F | E | F |
| 10 | C | B | H |
| 11 | F | D | B |
| 12 | A | E | F |
| 13 | E | D | E |
| 14 | C | A | F |
| 15 | F | E | H |
| 16 | B | G | C |
| 17 | F | D | F |
| 18 | C | B | D |
| 19 | E | F | E |
| 20 | F | D | F |

FIG.11

| CURRENT GAME SOUND | VARIATION VALUE | SUBSEQUENT GAME SOUND |
|---|---|---|
| GAME SOUND1 | 0~+4 | GAME SOUND1, GAME SOUND2, GAME SOUND3, GAME SOUND4, GAME SOUND5 |
| GAME SOUND2 | -1~+3 | GAME SOUND1, GAME SOUND2, GAME SOUND3, GAME SOUND4, GAME SOUND5 |
| GAME SOUND3 | -2~+2 | GAME SOUND1, GAME SOUND2, GAME SOUND3, GAME SOUND4, GAME SOUND5 |
| GAME SOUND4 | 0~+1 | GAME SOUND4, GAME SOUND5 |
| GAME SOUND5 | 0 | GAME SOUND5 |

FIG.12

| (A) | (B) | (C) | (D) |
|---|---|---|---|
| GAME CONDITION | CURRENT GAME SOUND | VARIATION VALUE | SUBSEQUENT GAME SOUND |
| REGULAR GAME | GAME SOUND1<br>GAME SOUND2<br>GAME SOUND3 | 0~+2<br>-1~+1<br>-2~0 | GAME SOUND1~3<br>GAME SOUND1~3<br>GAME SOUND1~3 |
| REGULAR GAME IN RB | GAME SOUND1<br>GAME SOUND2<br>GAME SOUND3<br>GAME SOUND4 | 0~+3<br>-1~+2<br>-2~+1<br>0 | GAME SOUND1~4<br>GAME SOUND1~4<br>GAME SOUND1~4<br>GAME SOUND4 |
| REGULAR GAME IN BB | GAME SOUND1<br>GAME SOUND2<br>GAME SOUND3<br>GAME SOUND4<br>GAME SOUND5 | 0~+4<br>-1~+3<br>-2~+2<br>0~+1<br>0 | GAME SOUND1~5<br>GAME SOUND1~5<br>GAME SOUND1~5<br>GAME SOUND4~5<br>GAME SOUND5 |

FIG.13

(a)

| | GAME SOUND1 | GAME SOUND2 | GAME SOUND3 | GAME SOUND4 | GAME SOUND5 | TOTAL OF PROBABILITY VALUES |
|---|---|---|---|---|---|---|
| REGULAR GAME | 80 | 38 | 10 | | | 128 |
| REGULAR GAME IN RB | 60 | 43 | 20 | 5 | | 128 |
| REGULAR GAME IN BB | 50 | 38 | 30 | 5 | 5 | 128 |

(UNIT:/128)

(b)

| | GAME SOUND1 | GAME SOUND2 | GAME SOUND3 | GAME SOUND4 | GAME SOUND5 | TOTAL OF PROBABILITY VALUES |
|---|---|---|---|---|---|---|
| REGULAR GAME | 30 | 78 | 20 | | | 128 |
| REGULAR GAME IN RB | 5 | 53 | 60 | 10 | | 128 |
| REGULAR GAME IN BB | 15 | 38 | 60 | 10 | 5 | 128 |

(UNIT:/128)

(c)

| | GAME SOUND1 | GAME SOUND2 | GAME SOUND3 | GAME SOUND4 | GAME SOUND5 | TOTAL OF PROBABILITY VALUES |
|---|---|---|---|---|---|---|
| REGULAR GAME | 50 | 38 | 40 | | | 128 |
| REGULAR GAME IN RB | 1 | 20 | 77 | 30 | | 128 |
| REGULAR GAME IN BB | 1 | 15 | 70 | 30 | 12 | 128 |

(UNIT:/128)

(d)

| | GAME SOUND1 | GAME SOUND2 | GAME SOUND3 | GAME SOUND4 | GAME SOUND5 | TOTAL OF PROBABILITY VALUES |
|---|---|---|---|---|---|---|
| REGULAR GAME | | | | | | |
| REGULAR GAME IN RB | | | | 128 | | 128 |
| REGULAR GAME IN BB | | | | 108 | 20 | 128 |

(UNIT:/128)

(e)

| | GAME SOUND1 | GAME SOUND2 | GAME SOUND3 | GAME SOUND4 | GAME SOUND5 | TOTAL OF PROBABILITY VALUES |
|---|---|---|---|---|---|---|
| REGULAR GAME | | | | | | |
| REGULAR GAME IN RB | | | | | | |
| REGULAR GAME IN BB | | | | | 128 | 128 |

(UNIT:/128)

FIG.14

| VARIATION VALUE | CURRENT GAME SOUND | NO PRIZE | PLUMS | BELLS | REPLAY | RB | BB |
|---|---|---|---|---|---|---|---|
| -1 | 3 | 1 | 3 | 2 | 2 | 4 | 4 |
| -2 | 2 | 25 | 25 | 25 | 25 | 5 | 5 |
| | 3 | 25 | 25 | 25 | 25 | 5 | 5 |
| 0 | 1 | 6 | 9 | 8 | 7 | 12 | 12 |
| | 2 | 6 | 9 | 8 | 7 | 12 | 12 |
| | 3 | 6 | 9 | 8 | 7 | 12 | 12 |
| | 4 | 10 | 10 | 10 | 10 | | |
| | 5 | 11 | 11 | 11 | 11 | | |
| +1 | 1 | 13 | 16 | 15 | 14 | 17 | 18 |
| | 2 | 13 | 16 | 15 | 14 | 17 | 18 |
| | 3 | 19 | 19 | 19 | 19 | | |
| | 4 | 19 | 19 | 19 | 19 | | |
| +2 | 1 | 26 | 26 | 26 | 26 | 20 | 21 |
| | 2 | 22 | 22 | 22 | 22 | | |
| | 3 | 22 | 22 | 22 | 22 | | |
| +3 | 1 | 23 | 23 | 23 | 23 | | |
| | 2 | 23 | 23 | 23 | 23 | | |
| +4 | 1 | 24 | 24 | 24 | 24 | | |

FIG.15

(a)GAME START SOUND/ROTATION REEL LAMP OPERATION GROUP1

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 25 | 1 | 1 | 1 | 2 |
| 25 | 1 | 1 | 2 | 1 |
| 50 | 1 | 2 | 1 | 1 |
| 50 | 1 | 0 | 3 | 1 |
| 50 | 1 | 0 | 1 | 3 |
| 28 | 1 | 1 | 0 | 3 |
| 28 | 1 | 1 | 3 | 0 |

(b)GAME START SOUND/ROTATION REEL LAMP OPERATION GROUP2

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 25 | 1 | 0 | 3 | 1 |
| 25 | 1 | 0 | 1 | 3 |
| 50 | 1 | 2 | 1 | 1 |
| 28 | 1 | 1 | 3 | 0 |
| 50 | 1 | 3 | 0 | 1 |
| 50 | 1 | 3 | 1 | 0 |

(c)GAME START SOUND/ROTATION REEL LAMP OPERATION GROUP3

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 100 | 1 | 0 | 2 | 2 |
| 56 | 1 | 2 | 0 | 2 |
| 100 | 1 | 2 | 2 | 0 |

(d)GAME START SOUND/ROTATION REEL LAMP OPERATION GROUP4

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 50 | 1 | 3 | 0 | 1 |
| 50 | 1 | 3 | 1 | 0 |
| 30 | 1 | 0 | 0 | 4 |
| 30 | 1 | 0 | 4 | 0 |
| 20 | 1 | 0 | 3 | 1 |
| 20 | 1 | 0 | 1 | 3 |
| 15 | 1 | 1 | 0 | 3 |
| 16 | 1 | 1 | 3 | 0 |
| 25 | 1 | 4 | 0 | 0 |

FIG.16

(e)GAME START SOUND/ROTATION REEL LAMP OPERATION GROUP5

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 20 | 1 | 1 | 0 | 4 |
| 80 | 1 | 1 | 4 | 0 |
| 6 | 1 | 0 | 1 | 4 |
| 10 | 1 | 0 | 4 | 1 |
| 10 | 1 | 1 | 1 | 3 |
| 10 | 1 | 1 | 3 | 1 |
| 20 | 1 | 3 | 1 | 1 |
| 50 | 1 | 4 | 0 | 1 |
| 50 | 1 | 4 | 1 | 0 |

(f)GAME START SOUND/ROTATION REEL LAMP OPERATION GROUP6

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 3 | 1 | 1 | 1 | 4 |
| 3 | 1 | 1 | 4 | 1 |
| 4 | 1 | 4 | 1 | 1 |
| 20 | 1 | 4 | 0 | 2 |
| 20 | 1 | 4 | 2 | 0 |
| 20 | 1 | 0 | 2 | 4 |
| 20 | 1 | 0 | 4 | 2 |
| 5 | 1 | 2 | 0 | 4 |
| 5 | 1 | 2 | 4 | 0 |
| 156 | 1 | 2 | 2 | 2 |

(g)GAME START SOUND/ROTATION REEL LAMP OPERATION GROUP7

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 20 | 1 | 0 | 2 | 4 |
| 20 | 1 | 0 | 4 | 2 |
| 5 | 1 | 2 | 0 | 4 |
| 5 | 1 | 2 | 4 | 0 |
| 156 | 1 | 2 | 2 | 2 |
| 25 | 1 | 4 | 0 | 2 |
| 25 | 1 | 4 | 2 | 0 |

(h)GAME START SOUND/ROTATION REEL LAMP OPERATION GROUP8

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 5 | 1 | 1 | 2 | 3 |
| 5 | 1 | 1 | 3 | 2 |
| 30 | 1 | 2 | 1 | 3 |
| 30 | 1 | 2 | 3 | 1 |
| 10 | 1 | 3 | 1 | 2 |
| 20 | 1 | 3 | 2 | 1 |
| 156 | 1 | 2 | 2 | 2 |

FIG.17

(i)GAME START SOUND/ROTATION REEL LAMP OPERATION GROUP9

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 156 | 1 | 2 | 2 | 2 |
| 30 | 1 | 1 | 1 | 4 |
| 50 | 1 | 1 | 4 | 1 |
| 20 | 1 | 4 | 1 | 1 |

(j)GAME START SOUND/ROTATION REEL LAMP OPERATION GROUP10

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 20 | 1 | 4 | 1 | 1 |
| 40 | 1 | 1 | 2 | 3 |
| 40 | 1 | 1 | 3 | 2 |
| 10 | 1 | 1 | 1 | 4 |
| 10 | 1 | 1 | 4 | 1 |
| 36 | 1 | 2 | 2 | 2 |
| 10 | 1 | 2 | 1 | 3 |
| 10 | 1 | 2 | 3 | 1 |
| 40 | 1 | 3 | 1 | 2 |
| 40 | 1 | 3 | 2 | 1 |

(k)GAME START SOUND/ROTATION REEL LAMP OPERATION GROUP11

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 256 | 1 | 2 | 2 | 2 |

(l)GAME START SOUND/ROTATION REEL LAMP OPERATION GROUP12

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 41 | 1 | 2 | 2 | 2 |
| 10 | 1 | 0 | 3 | 3 |
| 10 | 1 | 0 | 2 | 4 |
| 10 | 1 | 0 | 4 | 2 |
| 15 | 1 | 2 | 0 | 4 |
| 15 | 1 | 2 | 4 | 0 |
| 35 | 1 | 3 | 0 | 3 |
| 20 | 1 | 3 | 3 | 0 |
| 20 | 1 | 4 | 0 | 2 |
| 20 | 1 | 4 | 2 | 0 |
| 10 | 1 | 2 | 3 | 4 |
| 10 | 1 | 2 | 4 | 3 |
| 10 | 1 | 3 | 2 | 4 |
| 10 | 1 | 3 | 4 | 2 |
| 10 | 1 | 4 | 2 | 3 |
| 10 | 1 | 4 | 3 | 2 |

FIG.18

(m)GAME START SOUND/ROTATION REEL LAMP OPERATION GROUP13

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 50 | 1 | 1 | 0 | 4 |
| 50 | 1 | 1 | 4 | 0 |
| 78 | 1 | 2 | 1 | 4 |
| 78 | 1 | 2 | 4 | 1 |

(n)GAME START SOUND/ROTATION REEL LAMP OPERATION GROUP14

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 28 | 1 | 0 | 3 | 4 |
| 28 | 1 | 0 | 4 | 3 |
| 40 | 1 | 3 | 0 | 4 |
| 40 | 1 | 3 | 4 | 0 |
| 60 | 1 | 4 | 0 | 3 |
| 60 | 1 | 4 | 3 | 0 |

(o)GAME START SOUND/ROTATION REEL LAMP OPERATION GROUP15

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 156 | 1 | 4 | 1 | 2 |
| 100 | 1 | 4 | 2 | 1 |

(p)GAME START SOUND/ROTATION REEL LAMP OPERATION GROUP16

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 100 | 1 | 4 | 2 | 1 |
| 56 | 1 | 4 | 1 | 2 |
| 30 | 1 | 2 | 2 | 3 |
| 30 | 1 | 2 | 3 | 2 |
| 40 | 1 | 3 | 2 | 2 |

(q)GAME START SOUND/ROTATION REEL LAMP OPERATION GROUP17

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 28 | 1 | 3 | 1 | 3 |
| 28 | 1 | 3 | 3 | 1 |
| 50 | 1 | 1 | 0 | 4 |
| 50 | 1 | 1 | 4 | 0 |
| 50 | 1 | 1 | 3 | 3 |
| 15 | 1 | 2 | 1 | 4 |
| 35 | 1 | 2 | 4 | 1 |

FIG.19

(r)GAME START SOUND/ROTATION REEL LAMP OPERATION GROUP18

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 50 | 1 | 1 | 0 | 4 |
| 50 | 1 | 1 | 4 | 0 |
| 50 | 1 | 1 | 3 | 3 |
| 15 | 1 | 2 | 1 | 4 |
| 35 | 1 | 2 | 4 | 1 |
| 13 | 1 | 3 | 1 | 3 |
| 13 | 1 | 3 | 3 | 1 |
| 15 | 2 | 2 | 2 | 3 |
| 12 | 2 | 2 | 3 | 2 |
| 3 | 2 | 3 | 2 | 2 |

(s)GAME START SOUND/ROTATION REEL LAMP OPERATION GROUP19

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 30 | 1 | 1 | 0 | 4 |
| 30 | 1 | 1 | 4 | 0 |
| 15 | 1 | 2 | 1 | 4 |
| 15 | 1 | 2 | 2 | 3 |
| 15 | 1 | 2 | 3 | 2 |
| 15 | 1 | 2 | 4 | 1 |
| 26 | 1 | 3 | 2 | 2 |
| 50 | 1 | 4 | 1 | 2 |
| 60 | 1 | 4 | 2 | 1 |

(t)GAME START SOUND/ROTATION REEL LAMP OPERATION GROUP20

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 20 | 1 | 4 | 1 | 3 |
| 46 | 1 | 4 | 3 | 1 |
| 10 | 1 | 0 | 4 | 4 |
| 15 | 1 | 1 | 3 | 4 |
| 15 | 1 | 1 | 4 | 3 |
| 30 | 1 | 2 | 3 | 3 |
| 20 | 1 | 3 | 1 | 4 |
| 20 | 1 | 3 | 2 | 3 |
| 20 | 1 | 3 | 3 | 2 |
| 20 | 1 | 3 | 4 | 1 |
| 10 | 1 | 4 | 0 | 4 |
| 30 | 1 | 4 | 4 | 0 |

FIG.20

(u)GAME START SOUND/ROTATION REEL LAMP OPERATION GROUP21

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 10 | 1 | 0 | 4 | 4 |
| 15 | 1 | 1 | 3 | 4 |
| 15 | 1 | 1 | 4 | 3 |
| 30 | 1 | 2 | 3 | 3 |
| 20 | 1 | 3 | 1 | 4 |
| 20 | 1 | 3 | 2 | 3 |
| 20 | 1 | 3 | 3 | 2 |
| 20 | 1 | 3 | 4 | 1 |
| 10 | 1 | 4 | 0 | 4 |
| 30 | 1 | 4 | 4 | 0 |
| 20 | 2 | 2 | 2 | 4 |
| 6 | 2 | 2 | 4 | 2 |
| 10 | 2 | 4 | 2 | 2 |
| 10 | 1 | 4 | 1 | 3 |
| 20 | 1 | 4 | 3 | 1 |

(v)GAME START SOUND/ROTATION REEL LAMP OPERATION GROUP22

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 10 | 1 | 4 | 1 | 3 |
| 20 | 1 | 4 | 3 | 1 |
| 106 | 1 | 1 | 3 | 4 |
| 50 | 1 | 1 | 4 | 3 |
| 20 | 1 | 3 | 1 | 4 |
| 50 | 1 | 3 | 4 | 1 |

(w)GAME START SOUND/ROTATION REEL LAMP OPERATION GROUP23

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 6 | 1 | 1 | 4 | 4 |
| 50 | 1 | 2 | 3 | 4 |
| 10 | 1 | 2 | 4 | 3 |
| 10 | 1 | 3 | 2 | 4 |
| 55 | 1 | 3 | 3 | 3 |
| 50 | 1 | 3 | 4 | 2 |
| 40 | 1 | 4 | 1 | 4 |
| 15 | 1 | 4 | 2 | 3 |
| 10 | 1 | 4 | 3 | 2 |
| 10 | 1 | 4 | 4 | 1 |

(x)GAME START SOUND/ROTATION REEL LAMP OPERATION GROUP24

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 96 | 1 | 2 | 4 | 4 |
| 70 | 1 | 3 | 3 | 4 |
| 20 | 1 | 3 | 4 | 3 |
| 20 | 1 | 4 | 2 | 4 |
| 20 | 1 | 4 | 3 | 3 |
| 30 | 1 | 4 | 4 | 2 |

FIG.21

(y-1)GAME START SOUND/ROTATION REEL LAMP OPERATION GROUP25

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 10 | 1 | 0 | 2 | 3 |
| 10 | 1 | 0 | 3 | 2 |
| 10 | 1 | 0 | 1 | 4 |
| 10 | 1 | 0 | 4 | 1 |
| 10 | 1 | 1 | 0 | 4 |
| 10 | 1 | 1 | 4 | 0 |
| 10 | 1 | 1 | 2 | 2 |
| 10 | 1 | 2 | 0 | 3 |
| 10 | 1 | 2 | 3 | 0 |
| 10 | 1 | 2 | 1 | 2 |
| 10 | 1 | 2 | 2 | 1 |
| 10 | 1 | 3 | 0 | 2 |
| 10 | 1 | 3 | 2 | 0 |
| 10 | 1 | 4 | 0 | 1 |
| 58 | 1 | 4 | 1 | 0 |
| 1 | 1 | 1 | 3 | 4 |
| 1 | 1 | 1 | 4 | 3 |
| 1 | 1 | 2 | 2 | 4 |
| 1 | 1 | 2 | 4 | 2 |
| 1 | 1 | 3 | 1 | 4 |
| 1 | 1 | 3 | 4 | 1 |
| 1 | 1 | 4 | 1 | 3 |
| 1 | 1 | 4 | 3 | 1 |
| 1 | 1 | 4 | 2 | 2 |
| 1 | 1 | 0 | 2 | 4 |
| 1 | 1 | 0 | 4 | 2 |
| 1 | 1 | 1 | 2 | 3 |
| 1 | 1 | 1 | 3 | 2 |
| 1 | 1 | 1 | 1 | 4 |
| 1 | 1 | 1 | 4 | 1 |
| 1 | 1 | 2 | 2 | 2 |
| 1 | 1 | 2 | 1 | 3 |
| 1 | 1 | 2 | 3 | 1 |
| 1 | 1 | 2 | 0 | 4 |
| 1 | 1 | 2 | 4 | 0 |
| 1 | 1 | 3 | 1 | 2 |
| 1 | 1 | 3 | 2 | 1 |
| 1 | 1 | 4 | 1 | 1 |
| 1 | 1 | 4 | 0 | 2 |
| 1 | 1 | 4 | 2 | 0 |
| 1 | 1 | 0 | 3 | 4 |
| 1 | 1 | 0 | 4 | 3 |
| 1 | 1 | 1 | 0 | 4 |
| 1 | 1 | 1 | 4 | 0 |
| 1 | 1 | 2 | 1 | 4 |
| 1 | 1 | 2 | 2 | 3 |
| 1 | 1 | 2 | 3 | 2 |
| 1 | 1 | 2 | 4 | 1 |
| 1 | 1 | 3 | 0 | 4 |
| 1 | 1 | 3 | 4 | 0 |

FIG.22

(y-2)

| | | | | |
|---|---|---|---|---|
| 1 | 1 | 3 | 2 | 2 |
| 1 | 1 | 4 | 0 | 3 |
| 1 | 1 | 4 | 3 | 0 |
| 1 | 1 | 4 | 1 | 2 |
| 1 | 1 | 4 | 2 | 1 |
| 1 | 1 | 2 | 3 | 4 |
| 1 | 1 | 2 | 4 | 3 |
| 1 | 1 | 3 | 2 | 4 |
| 1 | 1 | 3 | 4 | 2 |
| 1 | 1 | 4 | 2 | 3 |
| 1 | 1 | 4 | 3 | 2 |
| 1 | 1 | 0 | 3 | 1 |
| 1 | 1 | 0 | 1 | 3 |
| 1 | 1 | 0 | 2 | 2 |
| 1 | 1 | 1 | 1 | 2 |
| 1 | 1 | 1 | 2 | 1 |
| 1 | 1 | 1 | 0 | 3 |
| 1 | 1 | 1 | 3 | 0 |
| 1 | 1 | 2 | 0 | 2 |
| 1 | 1 | 2 | 2 | 0 |
| 1 | 1 | 2 | 1 | 1 |
| 1 | 1 | 3 | 0 | 1 |
| 1 | 1 | 3 | 1 | 0 |

FIG.23

(z-1)GAME START SOUND/ROTATION REEL LAMP OPERATION GROUP26

| PROBABILITY (/256) | GAME START SOUND | ROTATION REEL LAMP OPERATION PATTERN | | |
|---|---|---|---|---|
| | | FIRST ROTATION REEL STOPPED | SECOND ROTATION REEL STOPPED | THIRD ROTATION REEL STOPPED |
| 1 | 1 | 0 | 2 | 4 |
| 1 | 1 | 0 | 4 | 2 |
| 1 | 1 | 1 | 2 | 3 |
| 1 | 1 | 1 | 3 | 2 |
| 1 | 1 | 1 | 1 | 4 |
| 1 | 1 | 1 | 4 | 1 |
| 1 | 1 | 2 | 2 | 2 |
| 1 | 1 | 2 | 1 | 3 |
| 1 | 1 | 2 | 3 | 1 |
| 1 | 1 | 2 | 0 | 4 |
| 1 | 1 | 2 | 4 | 0 |
| 1 | 1 | 3 | 1 | 2 |
| 1 | 1 | 3 | 2 | 1 |
| 1 | 1 | 4 | 1 | 1 |
| 1 | 1 | 4 | 0 | 2 |
| 1 | 1 | 4 | 2 | 0 |
| 1 | 1 | 0 | 3 | 4 |
| 1 | 1 | 0 | 4 | 3 |
| 1 | 1 | 1 | 0 | 4 |
| 1 | 1 | 1 | 4 | 0 |
| 1 | 1 | 2 | 1 | 4 |
| 1 | 1 | 2 | 2 | 3 |
| 1 | 1 | 2 | 3 | 2 |
| 1 | 1 | 2 | 4 | 1 |
| 1 | 1 | 3 | 0 | 4 |
| 1 | 1 | 3 | 4 | 0 |
| 1 | 1 | 3 | 2 | 2 |
| 1 | 1 | 4 | 0 | 3 |
| 1 | 1 | 4 | 3 | 0 |
| 1 | 1 | 4 | 1 | 2 |
| 1 | 1 | 4 | 2 | 1 |
| 1 | 1 | 2 | 3 | 4 |
| 1 | 1 | 2 | 4 | 3 |
| 1 | 1 | 3 | 2 | 4 |
| 1 | 1 | 3 | 4 | 2 |
| 1 | 1 | 4 | 2 | 3 |
| 1 | 1 | 4 | 3 | 2 |
| 1 | 1 | 0 | 3 | 1 |
| 1 | 1 | 0 | 1 | 3 |
| 1 | 1 | 0 | 2 | 2 |
| 1 | 1 | 1 | 1 | 2 |
| 1 | 1 | 1 | 2 | 1 |
| 1 | 1 | 1 | 0 | 3 |
| 1 | 1 | 1 | 3 | 0 |
| 1 | 1 | 2 | 0 | 2 |
| 1 | 1 | 2 | 2 | 0 |
| 1 | 1 | 2 | 1 | 1 |
| 1 | 1 | 3 | 0 | 1 |
| 1 | 1 | 3 | 1 | 0 |
| 10 | 1 | 1 | 3 | 4 |
| 10 | 1 | 1 | 4 | 3 |

FIG.24

(z-2)

| | | | | |
|---|---|---|---|---|
| 10 | 1 | 2 | 2 | 4 |
| 10 | 1 | 2 | 4 | 2 |
| 10 | 1 | 3 | 1 | 4 |
| 10 | 1 | 3 | 4 | 1 |
| 10 | 1 | 4 | 1 | 3 |
| 10 | 1 | 4 | 3 | 1 |
| 106 | 1 | 4 | 2 | 2 |
| 1 | 2 | 2 | 2 | 3 |
| 1 | 2 | 2 | 3 | 2 |
| 1 | 2 | 3 | 2 | 2 |
| 1 | 2 | 2 | 2 | 4 |
| 1 | 2 | 2 | 4 | 2 |
| 1 | 2 | 4 | 2 | 2 |
| 1 | 1 | 0 | 2 | 3 |
| 1 | 1 | 0 | 3 | 2 |
| 1 | 1 | 0 | 1 | 4 |
| 1 | 1 | 0 | 4 | 1 |
| 1 | 1 | 1 | 0 | 4 |
| 1 | 1 | 1 | 4 | 0 |
| 1 | 1 | 1 | 2 | 2 |
| 1 | 1 | 2 | 0 | 3 |
| 1 | 1 | 2 | 3 | 0 |
| 1 | 1 | 2 | 1 | 2 |
| 1 | 1 | 2 | 2 | 1 |
| 1 | 1 | 3 | 0 | 2 |
| 1 | 1 | 3 | 2 | 0 |
| 1 | 1 | 4 | 0 | 1 |
| 1 | 1 | 4 | 1 | 0 |

FIG.25

ROTATION REEL LAMP OPERATION PATTERN 0

| STAGE | FLASH PATTERN | STAGE | FLASH PATTERN |
|---|---|---|---|
| 1 | (1) (2) (3)<br>(4) (5) (6)<br>(7) (8) (9) | 5 | (1) (2) (3)<br>(4) (5) (6)<br>(7) (8) (9) |
| 2 | (1) (2) (3)<br>(4) (5) (6)<br>(7) (8) (9) | 6 | (1) (2) (3)<br>(4) (5) (6)<br>(7) (8) (9) |
| 3 | (1) (2) (3)<br>(4) (5) (6)<br>(7) (8) (9) | 7 | (1) (2) (3)<br>(4) (5) (6)<br>(7) (8) (9) |
| 4 | (1) (2) (3)<br>(4) (5) (6)<br>(7) (8) (9) | 8 | (1) (2) (3)<br>(4) (5) (6)<br>(7) (8) (9) |

FIG.26

ROTATION REEL LAMP OPERATION PATTERN 1

| STAGE | FLASH PATTERN | STAGE | FLASH PATTERN |
|---|---|---|---|
| 1 | (1) (2) (3)<br>(4) (5) (6)<br>(7) (8) (9) | 3 | (1) (2) (3)<br>(4) (5) (6)<br>(7) (8) (9) |
| 2 | (1) (2) (3)<br>(4) (5) (6)<br>(7) (8) (9) | 4 | (1) (2) (3)<br>(4) (5) (6)<br>(7) (8) (9) |

FIG.27

ROTATION REEL LAMP OPERATION PATTERN 3

| STAGE | FLASH PATTERN | STAGE | FLASH PATTERN |
|---|---|---|---|
| 1 | (1) (2) (3)<br>(4) (5) (6)<br>(7) (8) (9) | 3 | (1) (2) (3)<br>(4) (5) (6)<br>(7) (8) (9) |
| 2 | (1) (2) (3)<br>(4) (5) (6)<br>(7) (8) (9) | 4 | (1) (2) (3)<br>(4) (5) (6)<br>(7) (8) (9) |

FIG.28

ROTATION REEL LAMP OPERATION PATTERN 4

| STAGE | FLASH PATTERN | STAGE | FLASH PATTERN |
|---|---|---|---|
| 1 | (1) (2) (3)<br>(4) (5) (6)<br>(7) (8) (9) | 5 | (1) (2) (3)<br>(4) (5) (6)<br>(7) (8) (9) |
| 2 | (1) (2) (3)<br>(4) (5) (6)<br>(7) (8) (9) | 6 | (1) (2) (3)<br>(4) (5) (6)<br>(7) (8) (9) |
| 3 | (1) (2) (3)<br>(4) (5) (6)<br>(7) (8) (9) | 7 | (1) (2) (3)<br>(4) (5) (6)<br>(7) (8) (9) |
| 4 | (1) (2) (3)<br>(4) (5) (6)<br>(7) (8) (9) | 8 | (1) (2) (3)<br>(4) (5) (6)<br>(7) (8) (9) |

FIG.29

| OPERATION PATTERN | ROTATION REEL LAMP OPERATION |
|---|---|
| 0 | MOVE DOWNWARD TWICE |
| 1 | MOVE DOWNWARD ONCE |
| 2 | NO MOVE |
| 3 | MOVE UPWARD ONCE |
| 4 | MOVE UPWARD TWICE |

FIG.31

(a)

| STOP | ROTATION REEL LAMP OPERATION PATTERN | ROTATION REEL LAMP OPERATION PATTERN-2 | TOTAL OF ROTATION REEL LAMP OPERATION PATTERN-2 | GAME CONDITION INDICATION LED OPERATION |
|---|---|---|---|---|
| FIRST STOP TIME | n1 (0~4) | n1-2 (-2~2) | n1-2=S1 (-2~2) | S1 OPERATION PATTERN |
| SECOND STOP TIME | n2 (0~4) | n2-2 (-2~2) | n1+n2-4=S2 (-4~4) | S2 OPERATION PATTERN |
| THIRD STOP TIME | n3 (0~4) | n3-2 (-2~2) | n1+n2+n3-6=S3 (-6~6) | S3 OPERATION PATTERN |
| MEDAL INSERTION FOR THE SUBSEQUENT GAME | | | | CLEARED (PATTERN 0) |

(b)

| TOTAL OF ROTATION REEL LAMP OPERATION PATTERN-2 | GAME CONDITION INDICATION LED OPERATION PATTERN |
|---|---|
| 0 | PATTERN 0 |
| 1 | PATTERN 1 |
| 2 | PATTERN 2 |
| 3 | PATTERN 3 |
| 4 | PATTERN 4 |

(c)

| STOP | REEL | ROTATION REEL LAMP OPERATION PATTERN | ROTATION REEL LAMP OPERATION PATTERN-2 | TOTAL OF ROTATION REEL LAMP OPERATION PATTERN-2 | GAME CONDITION INDICATION LED OPERATION |
|---|---|---|---|---|---|
| FIRST STOP TIME | FIRST ROTATION REEL | 4 | 2 | 2=2 | PATTERN1 |
| SECOND STOP TIME | SECOND ROTATION REEL | 1 | -1 | 2-1=1 | PATTERN2 |
| THIRD STOP TIME | THIRD ROTATION REEL | 2 | 0 | 2-1+0=1 | PATTERN3 |
| MEDALIN SERTION FOR THE SUBSEQUENT GAME | | | | | CLEARED (PATTERN 0) |

FIG.32

| GAME CONDITION | STAGE | FLASH PATTERN |
|---|---|---|
| PATTERN 0 UNDER REGULAR GAME CONDITION (CLEAR: FLASH PATTERN IS NOT DISPLAYED) | 1 | (A) (B) (C) (D) (E) (F) (G) (H) |
| | 2 | (A) (B) (C) (D) (E) (F) (G) (H) |
| | 3 | (A) (B) (C) (D) (E) (F) (G) (H) |
| PATTERN CHANGEOVER TIME (80.84ms) | 4 | (A) (B) (C) (D) (E) (F) (G) (H) |
| | 5 | (A) (B) (C) (D) (E) (F) (G) (H) |
| | 6 | (A) (B) (C) (D) (E) (F) (G) (H) |
| | 7 | (A) (B) (C) (D) (E) (F) (G) (H) |
| | 8 | (A) (B) (C) (D) (E) (F) (G) (H) |

FIG.33

| GAME CONDITION | STAGE | FLASH PATTERN |
|---|---|---|
| PATTERN1 UNDER REGULAR GAME CONDITION | 1 | (A) (B) (C) (D) (E) (F) (G) (H) |
| | 2 | (A) (B) (C) (D) (E) (F) (G) (H) |
| | 3 | (A) (B) (C) (D) (E) (F) (G) (H) |
| PATTERN CHANGEOVER TIME (80.84ms) | 4 | (A) (B) (C) (D) (E) (F) (G) (H) |
| | 5 | (A) (B) (C) (D) (E) (F) (G) (H) |
| | 6 | (A) (B) (C) (D) (E) (F) (G) (H) |
| | 7 | (A) (B) (C) (D) (E) (F) (G) (H) |
| | 8 | (A) (B) (C) (D) (E) (F) (G) (H) |

FIG.34

| GAME CONDITION | STAGE | FLASH PATTERN |
|---|---|---|
| PATTERN2 UNDER REGULAR GAME CONDITION | 1 | (A) (B) (C) (D) (E) (F) (G) (H) |
| | 2 | (A) (B) (C) (D) (E) (F) (G) (H) |
| | 3 | (A) (B) (C) (D) (E) (F) (G) (H) |
| PATTERN CHANGEOVER TIME (80.84ms) | 4 | (A) (B) (C) (D) (E) (F) (G) (H) |
| | 5 | (A) (B) (C) (D) (E) (F) (G) (H) |
| | 6 | (A) (B) (C) (D) (E) (F) (G) (H) |
| | 7 | (A) (B) (C) (D) (E) (F) (G) (H) |
| | 8 | (A) (B) (C) (D) (E) (F) (G) (H) |

FIG.35

| GAME CONDITION | STAGE | FLASH PATTERN |
|---|---|---|
| PATTERN3 UNDER REGULAR GAME CONDITION | 1 | (A) (B) (C) (D) (E) (F) (G) (H) |
| | 2 | (A) (B) (C) (D) (E) (F) (G) (H) |
| | 3 | (A) (B) (C) (D) (E) (F) (G) (H) |
| PATTERN CHANGEOVER TIME (80.84ms) | 4 | (A) (B) (C) (D) (E) (F) (G) (H) |
| | 5 | (A) (B) (C) (D) (E) (F) (G) (H) |
| | 6 | (A) (B) (C) (D) (E) (F) (G) (H) |
| | 7 | (A) (B) (C) (D) (E) (F) (G) (H) |
| | 8 | (A) (B) (C) (D) (E) (F) (G) (H) |

FIG.36

| GAME CONDITION | STAGE | FLASH PATTERN |
|---|---|---|
| PATTERN4 UNDER REGULAR GAME CONDITION | 1 | (A) (B) (C) (D) (E) (F) (G) (H) |
| | 2 | (A) (B) (C) (D) (E) (F) (G) (H) |
| | 3 | (A) (B) (C) (D) (E) (F) (G) (H) |
| PATTERN CHANGEOVER TIME (80.84ms) | 4 | (A) (B) (C) (D) (E) (F) (G) (H) |
| | 5 | (A) (B) (C) (D) (E) (F) (G) (H) |
| | 6 | (A) (B) (C) (D) (E) (F) (G) (H) |
| | 7 | (A) (B) (C) (D) (E) (F) (G) (H) |
| | 8 | (A) (B) (C) (D) (E) (F) (G) (H) |

FIG.37

| GAME START SOUND | ROTATION REEL LAMP OPERATION PATTERN | | |
|---|---|---|---|
| | FIRST ROTATION REEL STOPPED | SECOND ROTATION REEL STOPPED | THIRD ROTATION REEL STOPPED |
| 1 | 0 | 0 | 4 |
| 1 | 0 | 4 | 0 |
| 1 | 4 | 0 | 0 |
| 1 | 1 | 1 | 3 |
| 1 | 1 | 3 | 1 |
| 1 | 3 | 1 | 1 |
| 1 | 0 | 3 | 3 |
| 1 | 3 | 0 | 3 |
| 1 | 3 | 3 | 0 |
| 1 | 1 | 3 | 3 |
| 1 | 3 | 1 | 3 |
| 1 | 3 | 3 | 1 |
| 1 | 0 | 4 | 4 |
| 1 | 2 | 3 | 3 |
| 1 | 3 | 2 | 3 |
| 1 | 3 | 3 | 2 |
| 1 | 4 | 0 | 4 |
| 1 | 4 | 4 | 0 |
| 1 | 1 | 4 | 4 |
| 1 | 3 | 3 | 3 |
| 1 | 4 | 1 | 4 |
| 1 | 4 | 4 | 1 |
| 1 | 2 | 4 | 4 |
| 1 | 3 | 3 | 4 |
| 1 | 3 | 4 | 3 |
| 1 | 4 | 2 | 4 |
| 1 | 4 | 3 | 3 |
| 1 | 4 | 4 | 2 |

FIG.47

(a)

| FIRST ROTATION REEL | SECOND ROTATION REEL | THIRD ROTATION REEL |
|---|---|---|
| F | ↓ | ↓ |
| A | ↓ | ↓ |
| E | ↓ | ↓ |

(b)

| FIRST ROTATION REEL | SECOND ROTATION REEL | THIRD ROTATION REEL |
|---|---|---|
| F | D | ↓ |
| A | A | ↓ |
| E | E | ↓ |

(c)

| | FIRST ROTATION REEL | SECOND ROTATION REEL | THIRD ROTATION REEL |
|---|---|---|---|
| PRIZE WINNING LINE L1 | A | A | ↓ |
| PRIZE WINNING LINE L2A | F | D | ↓ |
| PRIZE WINNING LINE L2B | E | E | ↓ |
| PRIZE WINNING LINE L3A | F | A | ↓ |
| PRIZE WINNING LINE L3B | E | A | ↓ |

FIG.48

| CODE No. | PRIZE WINNING EXPECTATION FLAG | | | |
|---|---|---|---|---|
| | BIG PRIZE | MIDDLE PRIZE | SMALL PRIZE | NO PRIZE |
| 0 | 0 | 0 | 0 | 1 |
| 1 | 0 | 1 | 0 | 0 |
| 2 | 0 | 1 | 0 | 0 |
| 3 | 0 | 0 | 0 | 1 |
| 4 | 0 | 0 | 0 | 1 |
| 5 | 1 | 0 | 1 | 0 |
| ⋮ | ⋮ | ⋮ | ⋮ | ⋮ |
| 20 | 0 | 0 | 0 | 1 |

GAME MACHINE

BACKGROUND OF INVENTION

1. Field of the Invention

The present invention relates to a game machine which can provide a game player with a thrilling and exciting fun in a game, and in particular to a game machine which comprises shift and display means for shifting and displaying various kinds of symbol marks, notifying means for notifying a game player various information and awarding means for awarding a winning prize to a game player when a predetermined set of symbol marks are stopped and displayed on a prize winning line.

2. Description of the Related Art

There has so far been provided a slot machine which is among those types of the game machine. The slot machines are described above are well known in the art. In general, such a known slot machine comprises a front panel, and three rotation reels juxtaposed in the rear side of the front panel and rotatably supported on the body of the slot machine. Each of the rotation reels has a peripheral surface having thereon various kinds of symbol marks arranged in a row at a predetermined interval. Within each of the rotation reels is provided an internal light which can light the symbol marks on the peripheral surface of the rotation reel from the rear side of the symbol marks to ensure that a game player can observe the symbol marks respectively through observation windows formed in the front panel. On the observation windows of the front panel is drawn five prize winning lines which make it possible for the game player to enjoy a game with thrilling and exciting feelings so that any predetermined set of the symbol marks will be stopped and displayed in line on any of the five prize winning lines or not.

The game machine is started by the game player when he or she inserts a game medal into a medal inserting opening. With the operation of a start lever after the game medal inserting operation by the game player, the rotation reels concurrently start rotating so that the game player can observe through the observation windows the symbol marks rotating in the direction that the symbol marks are arranged in a row on the peripheral surfaces of the rotation reels. The rotation reels which are rotated to reach a predetermined speed level make effective the operation of stop buttons respectively provided to be operable for the rotation reels.

The game player can operate the stop buttons while observing the symbol marks to independently stop the rotation reels from rotating with the aim of stopping and displaying the desired set of symbol marks in line on any one of the prize winning lines of the observation windows. This means that the rotation reels are designed to be stopped from rotating in timing with the operations of the respective stop buttons. The predetermined sets of the symbol marks on the prize winning lines of the observation windows appearing at the time of the rotation reels' standstill results in making it possible for the game player to get a prize winning based on the set of the lined-up symbol marks on the observation windows.

The prize winning states include a big prize winning, a medium prize winning, and a small prize winning. The big prize winning and the medium prize winning are won with three symbol marks of "7" or other predetermined symbol marks which are stopped from rotating in line by the game player on the prize winning lines of the observation windows. The big prize winning allows the game player to play a big bonus game (BB game), while the medium prize winning allowing the game player to play a regular bonus game (RB game). These big and medium prize winnings mean that the game player can have respective rights to play a special bonus game by which the game player can obtain a large number of coins. On the contrary, the small prize winning can entitle the game player to get a few coins when the rotation reels are stopped by him or her with a predetermined number of symbol marks such as "plums" and "bells" being stopped from rotating in line on any of the prize winning lines of the observation windows.

The aforementioned prize winning states are determined based on a lottery operation using random numbers performed immediately after the start lever is operated by the game player. This means that the prize winning states are defined prior to the stop operation of the rotation reels by the game player. The lottery operation using random numbers is carried out by prize winning determining means which is assembled in the game machine. In response to the stop operation by the game player, the rotation reels are controlled to stop from rotating so that the game player can experience in reality a prize winning when the set of the corresponding symbol marks determined on the basis of the lottery operation using the random numbers displayed and stopped in line on any of the prize winning lines of the observation windows.

The above mentioned lottery operation using random numbers can determine the big prize winning which in turn raises a prize winning flag, and a notification flag with a predetermined probability. The notification flag thus raised serves to light an indication device such as a notification light provided in front of the front panel of the slot machine, thereby notifying the game player of winning the big prize winning through the lottery operation of the slot machine. The prize winning flag thus raised will remain in the subsequent game if the set of symbol marks corresponding to the big prize winning fail to be stopped and displayed on any of the prize winning lines in the current game. As a result, the notification light continues to turn on until the set of the symbol marks corresponding to the big prize winning are stopped and displayed on any of the prize winning lines.

The aforesaid conventional game machine, for instance, is operative to generate a big prize winning state by the lottery action with random numbers to raise a notification flag for notifying a game player of the big prize winning. The notification flag remains for the subsequent games only when that the result of the internal lottery operation is ensured to be notified to the game player. In other words, the notification flag will not remain for the subsequent games, if it is not ensured that the result is notified to the game player.

The conventional game machine cannot associate the current notification with the subsequent notifications. This means that a subsequent notification is notified independent from the current notification, thereby causing the contents of the current notification to be interrupted when the subsequent notification starts. This results in the fact that the fun of the games fail to be provided, thus the game player feels bored.

The aforesaid conventional machine is operated to notify the game player of the big prize inner winning generated by lottery action. On the contrary, the big prize winning itself is rarely generated, and the thus generated big prize winning simply causes to light on an indication lamp, being unable to provide the fun of the games.

The aforesaid conventional game machine displays a set of symbol marks called "li-zhi" (for notifying the game player that the big prize inner winning is generated by lottery action) with the rotation reels stopped from rotating so that the game player can aim at the target set of symbol marks. On the contrary, only skillful game players can read "li-zhi" state by careful observation of set of symbol marks displayed in the observation window while it is difficult for game players with no experience to read the "li-zhi" state.

SUMMARY OF THE INVENTION

It is therefore an object of the present invention to provide a game machine which can provide a game player with a subsequent notification notified independent from the current notification.

It is another object of the present invention to provide a game machine which makes the contents of the current notification to be interrupted when the subsequent notification starts.

It is a further object of the present invention to provide a game machine which can provide a game player with the improved fun of the games to the degree that the game player feels excited and thrilled.

In accordance with the first aspect of the present invention, there is provided a game machine comprising: shift and display means for shifting and displaying a plurality of rows each having a plurality of symbol marks thereon, prize winning state determining means for determining a prize winning state based on random number lottery, stop control means for controlling the stop of the shift and display means to have a predetermined set of symbol marks shifted and displayed on the basis of the prize winning state determined by the prize winning state determining means, notifying means for notifying a game player of notifying information in notifying states including a current notifying state and subsequent notifying states following the current notifying state, while the game player is enjoying games including a current game and subsequent games following the current game, and subsequent notifying state determining means for determining and selecting in advance the subsequent notifying states in the current game on the basis of the current notifying state to be informed by the notifying means.

In accordance with the second aspect of the present invention, the game machine further comprises: second notifying means provided separately from the notifying means to notify a game player of notifying information in a current notifying state, and second notifying state determining means for determining and selecting in advance the current notifying states on the basis of the subsequent notifying states determined by the subsequent notifying state determining means.

In accordance with the third aspect of the invention, the game machine is formed with a medal inserting slot, and the notifying means is operative to notify the game player of the notifying state determined by the subsequent notifying state determining means when the current or subsequent game starts with a game medium inserted in the medal inserting slot.

When the current notifying state in the current game is identical to the subsequent notifying states in the subsequent games, the notifying means may preferably continue to notify the game player of the identical notifying state without interruption.

The present invention further provide a game machine in which the notifying information notified by the notifying means may be correspondent to specified prize winning state determined by the prize winning state determining means.

According to another aspect of the present invention the notifying means may be operative to notify the game player of the notifying state corresponding to the prize winning state at a predetermined probability. The prize winning state may be any of big inner winning state or medium winning state. The game machine may be a slot machine or a pinball machine.

BRIEF DESCRIPTION OF THE DRAWINGS

The objects, features and advantages of the present invention will become apparent as the description proceeds when taken in conjunction with the accompanying drawings, in which:

FIG. 6 is a prize winning probability table used in the processing unit forming part of the slot machine according to the present invention, FIG. 7 is a symbol mark table to be used for processing a game play performed by the slot machine according to the present invention, FIG. 11 is a table showing a combination of a current game sound and a subsequent game sound processed to emit by the processing unit forming part of the slot machine according to the present invention, FIG. 12 is a table showing the relationships between current and subsequent game sounds in the current and subsequent game conditions, respectively, processed by the processing unit forming part of the slot machine according to the present invention, FIGS. 13(*a*) to 13(*e*) are tables each showing a subsequent game sound selection probability table available upon selecting the second information notifying state in the processing unit forming part of the slot machine according to the present invention, FIG. 14 is a selection table showing the relationships between the game start sounds and the rotation reel lamp operation group numbers available upon selecting the second information notifying state in the processing unit forming part of the slot machine according to the present invention, FIGS. 15(*a*) to 15(*d*) are tables respectively showing the relationships between the game start sounds and the rotation reel lamp operation groups 1 to 4 available upon selecting the second information notifying state in the processing unit forming part of the slot machine according to the present invention, FIGS. 16(*e*) to 16(*h*) are tables respectively showing the relationships between the game start sounds and the rotation reel lamp operation groups 5 to 8 available upon selecting the sound information notifying state in the processing unit forming part of the slot machine according to the present invention, FIGS. 17(*i*) to 17(*l*) are tables respectively showing the relationships between the game start sounds and the rotation reel lamp operation groups 9 to 12 available upon selecting the second information notifying state in the processing unit forming part of the slot machine according to the present invention, FIGS. 18(*m*) to 18(*q*) are tables respectively showing the relationships between the game start sounds and the rotation reel lamp operation groups 13 to 17 available upon selecting the second information notifying state in the processing unit forming part of the slot machine according to the present invention, FIGS. 19(*r*) to 19(*t*) are tables respectively showing the relationships between the game start sounds and the rotation reel lamp operation groups 18 to 20 available upon selecting the second information notifying state in the processing unit forming part of the slot machine according to the present invention, FIGS. 20(*u*) to 20(*x*) are tables respectively showing the relationships between the game start sounds and the rotation reel lamp operation groups 21 to 24 available upon selecting the second information notifying state in the processing unit forming part of the slot machine according to the present invention, FIG. 21 is a table showing the former half of the relationships between the game start sounds and the rotation reel lamp operation group 25 available upon selecting the second information notifying state in the processing unit forming part of the slot machine according to the present invention, FIG. 22 is a table showing the latter half of the relationships between the game start sounds and the rotation reel lamp operation group 25 available upon selecting the second information notifying state in the processing unit forming part of the slot machine according to the present invention, FIG. 23 is a table showing the former half of the relationships between the game start sounds and the rotation reel lamp operation group 26 available upon selecting the second information notifying state in the processing unit forming part of the slot machine according to the present invention, FIG. 24 is a table showing the latter half of the relationships between the game start sounds and the rotation reel lamp operation group 26 available upon selecting the second information notifying state in the processing unit forming part of the slot machine according to the present invention, FIG. 25 is a table showing a rotation reel lamp operation pattern "0" to be used for the second notification of the current game in the processing unit forming part of the slot machine according to the present invention, FIG. 26 is a table showing a rotation reel lamp operation pattern "1" to be used for the second notification of the current game in the processing unit forming part of the slot machine according to the present invention, FIG. 27 is a table showing a rotation reel lamp operation pattern "3" to be used for the second notification of the current game in the processing unit forming part of the slot machine according to the present invention, FIG. 28 is a table showing a rotation reel lamp operation pattern "4" to be used for the second notification of the current game in the processing unit forming part of the slot machine according to the present invention, FIG. 29 is a table showing a rotation reel lamp operation pattern to be used for the first notification of the current game in the processing unit forming part of the slot machine according to the present invention, FIG. 32 is a table showing a game condition indication LED pattern "0" under the regular game condition which is used for the second notification of the current game in the process of the processing unit forming part of the slot machine according to the present invention, FIG. 33 is a table showing a game condition indication LED pattern "1" under the regular game condition which is used for the second notification of the current game in the process of the processing unit forming part of the slot machine according to the present invention, FIG. 34 is a table showing a game condition indication LED pattern "2" under the regular game condition which is used for the second notification of the current game in the process of the processing unit forming part of the slot machine according to the present invention, FIG. 35 is a table showing a game condition indication LED pattern "3" under the regular game condition which is used for the second notification of the current game in the process of the processing unit forming part of the slot machine according to the present invention, FIG. 36 is a table showing a game condition indication LED pattern "4" under the regular game condition which is used for the second notification of the current game in the process of the processing unit forming part of the slot machine according to the present invention, FIG. 37 is a table showing the relationships between the game start sounds and the rotation reel lamp operation patterns specified to satisfy the bonus condition in the process of the processing unit forming part of the slot machine according to the present invention, FIG. 48 is a table showing a hit-expectation flag which is available for the process of the processing unit forming part of the slot machine according to the present invention,

DESCRIPTION OF THE PREFERRED EMBODIMENTS

The detailed description of the preferred embodiment according to the present invention applied to a slot machine called "CT machine" will now be made hereinafter with reference to the drawings.

Figure 1:
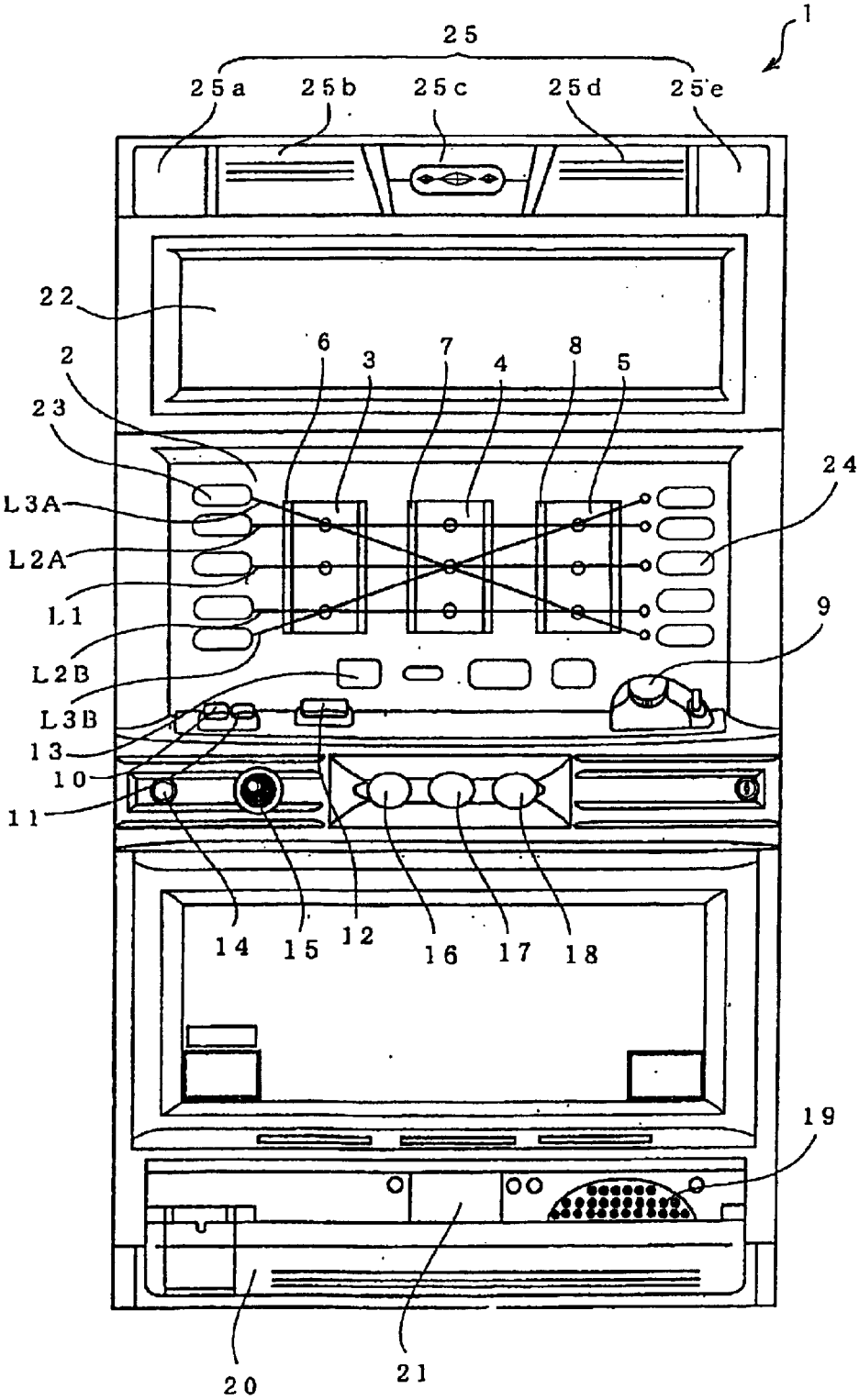
FIG. 1 is a front elevational view of one embodiment of the slot machine according to the present invention.

FIG. 1 is a front elevational view of the slot machine of the preferred embodiment.

The slot machine 1 shown in FIG. 1 comprises a front panel 2 having a rear portion which is adapted to rotatably support three rotation reels 3, 4 and 5 collectively constituting part of the shift and display means for shifting and displaying a plurality of rows each having plurality of symbol marks thereon. On the peripheral surface of each of the rotation reels 3, 4 and 5 is drawn a symbol row which is constituted by a plurality of symbol marks. Three symbol marks can be observed through the respective observation windows 6, 7 and 8 located on the front face of the slot machine 1. At the portion of the slot machine 1 on the lower and right side of the observation windows 6, 7 and 8 is provided a medal inserting slot 9 which serves to have the game player insert game medals therein.

Figure 2:
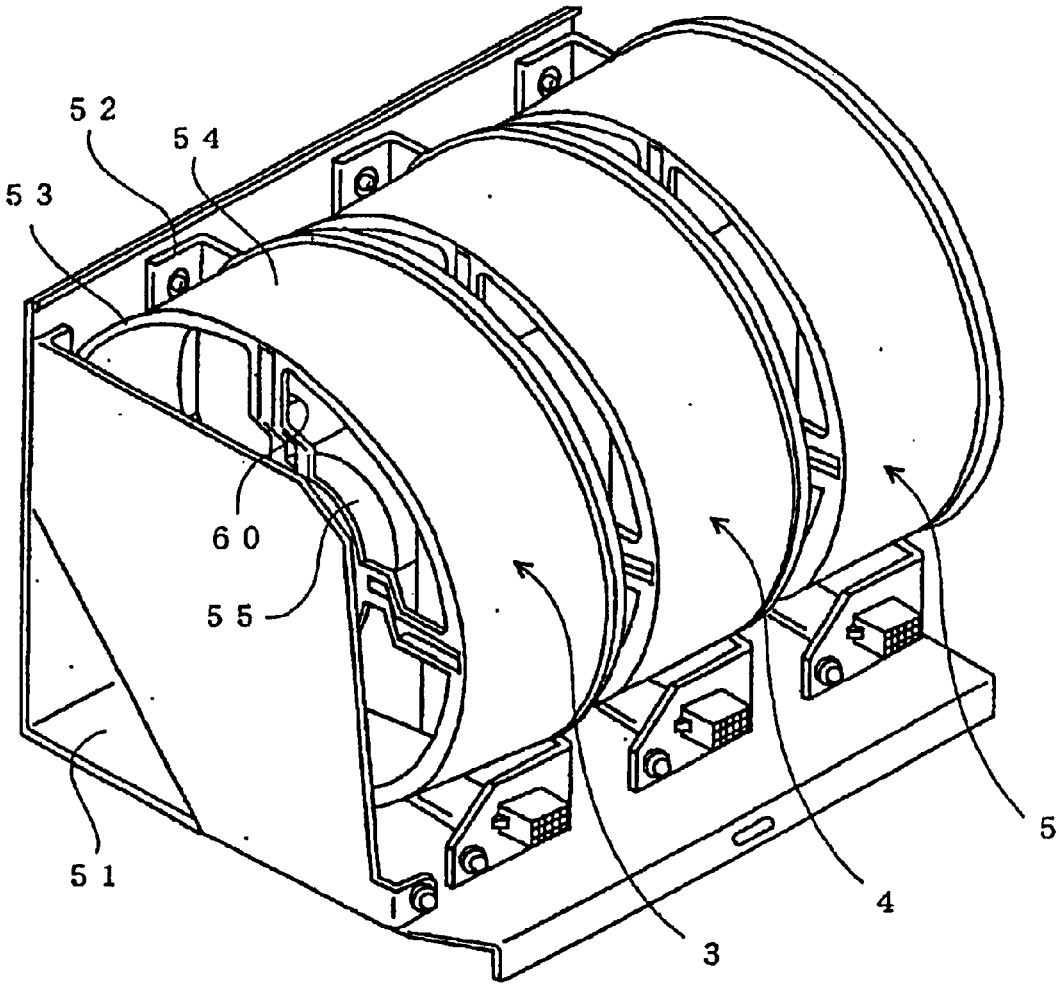
FIG. 2 is a perspective view of the rotation reel unit forming part of the slot machine according to the present invention, FIG. 3(*a*) is a perspective view, partly fragmentary, of the rotation reel forming part of the rotation reel unit of the slot machine according to the present invention, FIG. 3(*b*) is a perspective view of back lumps and a base plate having thereon the back lumps supported, FIG. 4(*a*) to FIG. 4(*c*) are diagrammatic views respectively showing winning lines in their effective state on the observation windows forming part of the rotation reel unit of the slot machine according to the present invention.

The rotation reels 3 to 5 are best shown in FIG. 2 as collectively constituting a rotation reel unit and are independently rotatably mounted on a frame 51 by respective brackets 52. Each of the rotation reels 3 to 5 has a rotation reel drum 53 having a peripheral surface to which a rotation reel band 54 is adhered. On the outer surface of the rotation reel band 54 is drawn a symbol row constituted by a plurality of different symbol marks. Each of the brackets 52 has attached thereto a stepping motor 55 enabling each of the rotation reels 3 to 5 to be driven to rotate.

The construction of each of the rotation reels 3 to 5 is particularly shown in FIG. 3(*a*). The constitutional elements and parts of each of the rotation reels 3 to 5 shown in FIG. 3(*a*) are substantially identical to those of each of the rotation reels 3 to 5 in FIG. 2 illustrated bearing the reference numerals of the rotation reels 3 to 5 the same as those of the rotation reels 3 to 5 in FIG. 2 and will therefore be omitted in description hereinafter. The rotation reel drum 53 behind the rotation reel band 54 has a lamp case 56 therein. Back lamps 57*a*, 57*b*, and 57*c* are provided in the lamp cases 56. The back lamps 57*a*, 57*b*, and 57*c* are mounted in a base plate 58 as illustrated in FIG. 3(*b*). On the bracket 52 is mounted a photo sensor 59 which is designed to detect an light blocking plate 60 mounted on the rotation reel drum 53 passing through the photo sensor 59 as the rotation reel drum 53 makes a full rotation.

The light-on/off of each of the back lamps 57*a* to 57*c* is controlled by means of a lamp drive circuit 48 which will be described hereinafter. Each of the back lamps 57*a* to 57*c* individually illuminates the respective symbol mark drawn on the rotation reel band located from behind, thereby enabling three symbol marks to be projected in the observation windows 6, 7 and 8.

Figure 4:
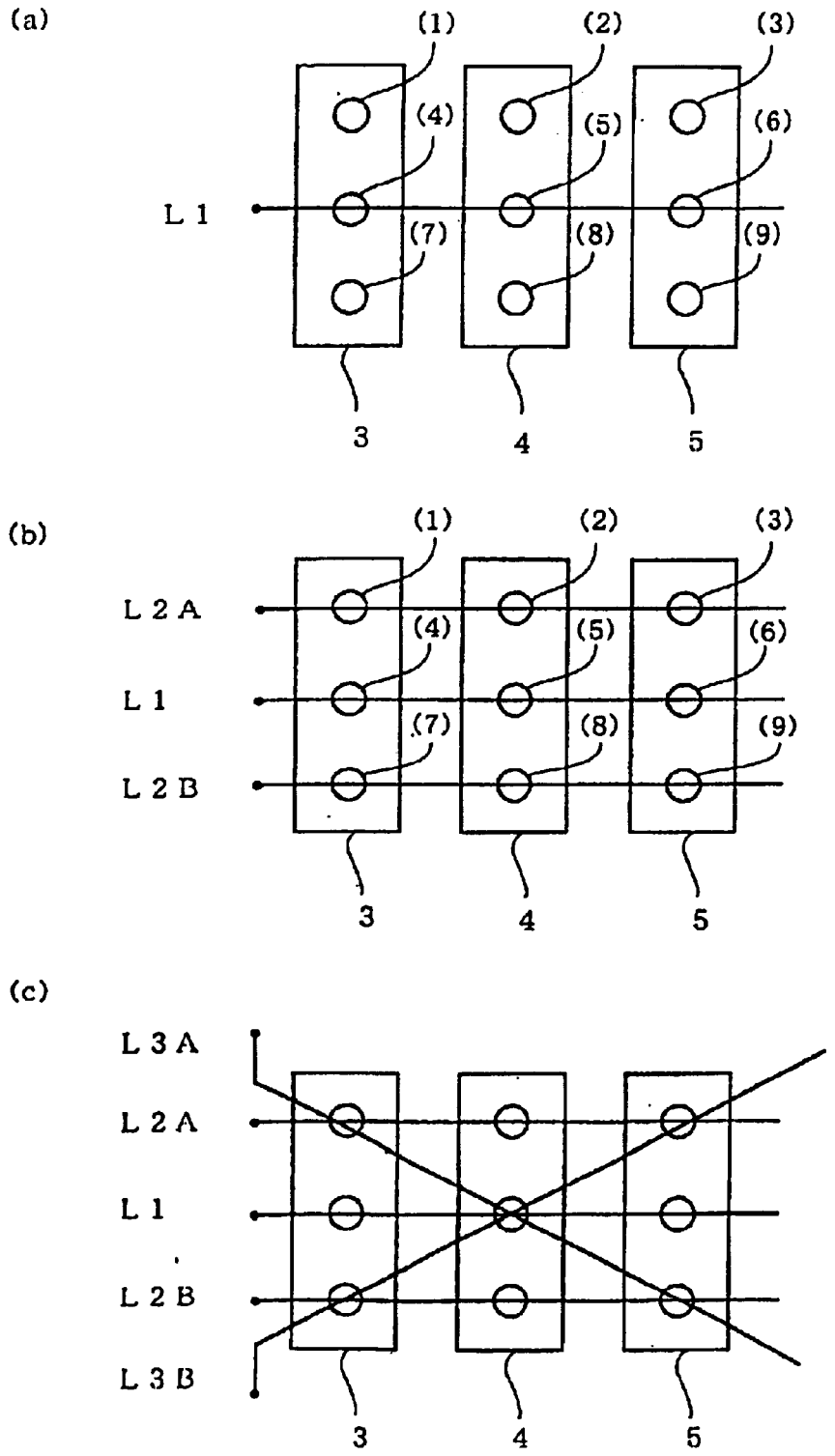

The observation windows 6, 7 and 8 have a plurality of prize winning lines in common respectively represented by lines in FIG. 1 including: a prize winning line L1 horizontally extending over the center of the area; a pair of prize winning lines L2A and L2B disposed on the upper and lower sides of the center prize winning line L1; and a pair of cross prize winning lines L3A and L3B crossed at oblique angles and traversing the prize winning lines L1, L2A and L2B. The insertion of one game medal into the medal inserting slot 9 by the game player makes only the center prize winning line L1 effective in betting as shown in FIG. 4(*a*). The insertion of two game medals into the medal inserting slot 9 the game player makes the upper and lower prize winning lines L2A and L2B effective in betting in addition to the center prize winning line L1 as shown in FIG. 4(*b*). The insertion of three game medals into the medal inserting slot 9 by the game player makes all of the prize winning lines L1, L2A, L2B, L3A and L3B effective in betting as shown in FIG. 4(*c*). At the ends of the prize winning lines are disposed effective line indication lamps 23, respectively (see FIG. 1) which is adapted to light on when any of the prize winning lines is made effective in betting, thereby making it possible for the game player to recognize the prize winning line effective in betting.

The back lamps 57*a* to 57*c* are shown by respective circles in FIGS. 4(*a*) to 4(*c*) to be accommodated in the rotation reels 3 to 5, respectively. In FIGS. 4(*a*) and 4(*b*), the back lamps 57*a* are arranged on the upper line of the rotation reels 3, 4 and 5 are represented by the circles (1), (2) and (3), respectively. Similarly, the back lamps 57*b* arranged on the intermediate line of the rotation reels 3, 4 and 5 are shown in FIGS. 4(*a*) and 4(*b*) as being represented by the circles (4), (5) and (6), respectively. The back lamps 57*c* arranged on the lower line of the rotation reels 3, 4 and 5 are also shown in FIGS. 4(*a*) and 4(*b*) as being represented by the circles (7), (8) and (9), respectively.

At the left side of the front panel 2 and below the observation windows 6 to 8 in FIG. 1 are disposed a 1 BET switch 10, a 2 BET switch 11 and a max BET switch 12. In the event that there are left game medals indicated as being credited on a credit indication portion 13, the aforesaid switches, i.e., the 1 BET switch 10, the 2 BET switch 11 and the max BET switch 12 are turned on to bet one, two and three game medals, respectively, in one game in place of the game medals inserted into the medal inserting slot 9. The credit indication portion 13 is constituted by 7-segment LEDs (light emitting diode) corresponding to the digit number of a numerical value displayed thereon, and thus is designed to indicate a medal number credited in the current game.

Below the BET switches 10 to 12 on the front panel 2 in FIG. 1 are provided a credit/pay-out switch (C/P switch) 14 and a start lever 15. At the right side of the start lever 15 or the central portion of the front panel are arranged stop buttons 16, 17 and 18. The operation of the C/P switch 14 makes it possible to change over the credit/pay-out of the medals.

The start lever 15 forms part of shift and display starting means for starting the display of the rotations of the rotation reels 3 to 5 so that the operation of the start lever 15 can start all the rotation reels 3 to 5 to rotate simultaneously. The stop buttons 16, 17 and 18 are arranged with respect to the rotation reels 3 to 5, respectively, and thus constitute part of stop control means for controlling the independently stopping of displaying the rotations of the individual rotation reels 3 to 5 in accordance with the prize winning state determined by the prize winning state determining means, which will be described later. The operation of the stop button 16 to 18 is made effective when the rotation reels 3 to 5 are driven to rotate at a predetermined rotation speed. This means that the game player can individually operated the stop buttons 16 to 18 to independently stop the rotation reels 3 to 5 at any time after the operation of the stop button 16 to 18 is made effective.

At the lower portion of the front panel 2 are provided sound penetrating holes 19 and a medal receptacle 20. The sound penetrating holes 19 are adapted to allow the sound emitted from a speaker housed within the slot machine 1 to be emitted out of the slot machine 1. The medal receptacle 20 serves to reserve game medals paid out from a medal paying-out opening 21 disposed at the upper side of the medal receptacle 20. On the front upper portion of the slot machine 1 is provided a dividend rate indication portion 22 for indicating the number of game medals to be paid out for each of prize winnings.

To the right side of the rotation reels 3 to 5 on the front panel 2 is provided a prize winning indication lamp 24 functions to inform the game player of the current game condition such as big prize winning game condition and middle prize winning game condition, which will be described later, when the prize winning indication lamp 24 is turn on. The prize winning indication lamp 24 is turned on at a predetermined provability by a lottery after the bonus game condition such as the big prize winning game condition and the middle prize winning game condition is determined.

At the upper side of the dividend rate indication portion 22 is provided a game condition indication LED 25 which is divided into five sections 25*a*, 25*b*, 25*c*, 25*d*, and 25*e*. The sections 25*a*, 25*b*, 25*d*, and 25*e* excluding the central section 25*c* have LEDs (A), (B), (G), and (H) respectively housed therein, while the central section 25*c* has four LEDs (C), (D), (E), and (F) also housed therein.

Figure 5:
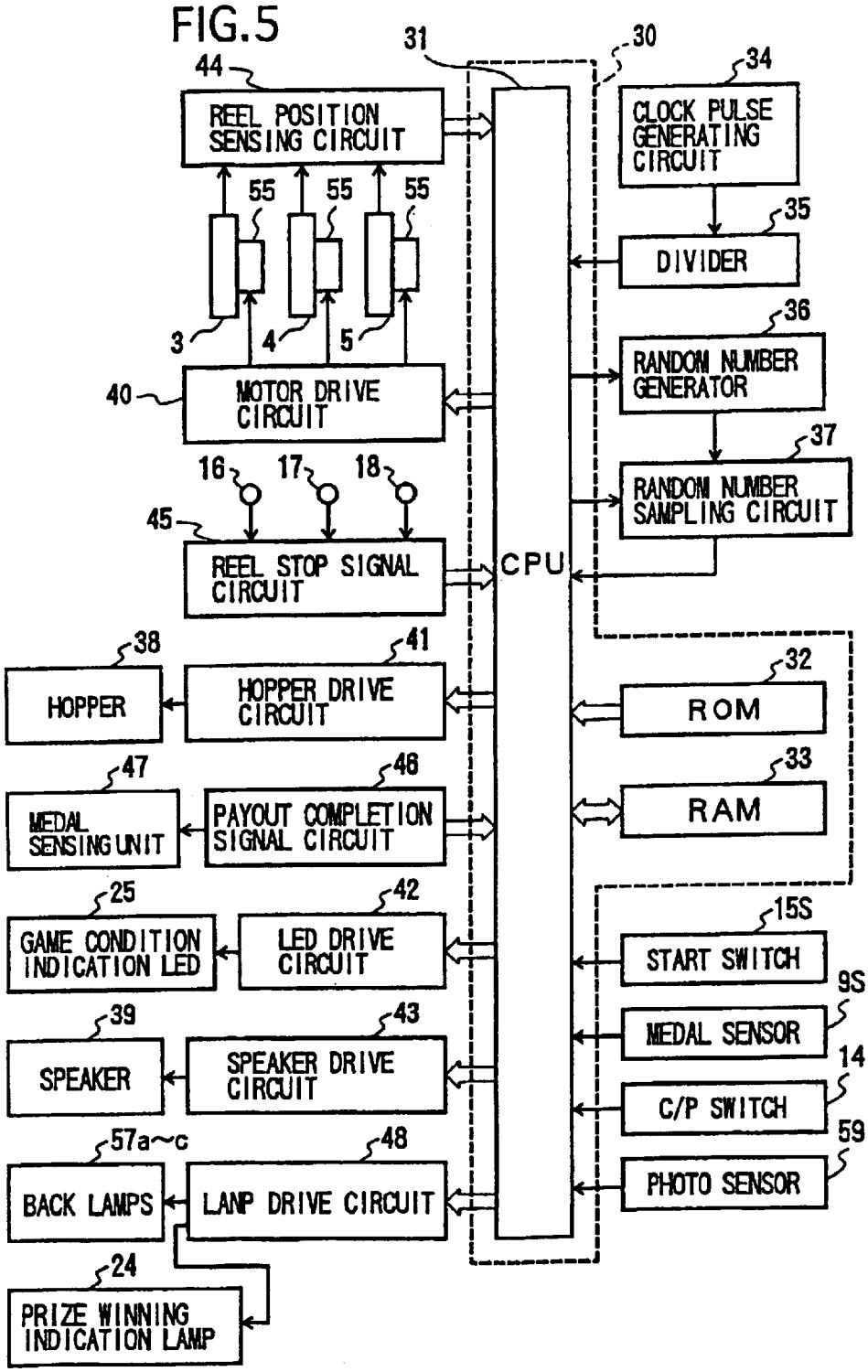
FIG. 5 is a block diagram showing a control circuit of the slot machine according to the present invention.

FIG. 5 shows an electric circuit which comprises control means for controlling the game processing operation of the slot machine 1 according to the present embodiment of the present invention, and peripheral devices (actuators) electrically connected with the control means.

The control means is mainly constituted by a microcomputer 30, hereinafter referred to as simply "micom", and a plurality of circuits for sampling random numbers. The micom 30 has a CPU31 for performing control operations on the basis of a predetermined program, a ROM32 and a RAM33. The ROM32 and the RAM33 collectively constitute storage means. The storage means is designed to store table data having a plurality of predetermined reference values such as table data. The CPU31 is further connected to a clock pulse generating circuit 34 for generating a base clock pulse, a divider 35, a random number generator 36 for generating random numbers within a defined range, and a random number sampling circuit 37 for sampling a single number from the generated random numbers. The random number generator 36 and the random number sampling circuit 37 collectively constitute random number generation means.

The micro 30 is operable to control the operations of the actuators e.g., stepping motors 55 for driving the rotation reels 3, 4 and 5, a hopper 38 for storing the game medals, the game condition indication LED 25, a speaker 39, the back lamps 57*a* to 57*c*, and the prize winning indication lamp 24. The actuators are driven by a motor drive circuit 40, a hopper drive circuit 41, an LED drive circuit 42, a speaker drive circuit 43, and a lamp drive circuit 48, respectively. The drive circuits 40, 41, 42 and 43, 48 are connected with the CPU 31 through I/O ports of the micom 30. Stepping motors 55 are energized in one/two-phase by the motor drive circuit 40 and each of the stepping motor 55 makes a full rotation with a 400-pulse drive signal.

The micro 30 is connected with sensors, including a start switch 15S for sensing the rocking operation of the start lever 15, a medal sensor 9S for sensing the insertion of the game medal(s) into the medal inserting slot 9, the aforesaid C/P switch 14, a photo sensor 59, and a reel position sensing circuit 44 for sensing the position of each of the rotation reels 3, 4 and 5 by receiving signals from the photo sensor 59.

The photo sensor 59 detects the light blocking plate 60 passing through the photo sensor 59 and thus generates a reset pulse as each of the rotation reels 4, 5 and 5 makes a full rotation. The thus generated reset pulse is transmitted to the CPU 31 through the rotation reel position sensing circuit 44. The RAM 33 contains discrete values specifying position ranges of the rotation reels 3, 4 and 5, respectively. The CPU 31 is operated to clear the respective value contained in the RAM 33 to zero upon receiving a reset pulse from any of the rotation reels 3, 4, and 5, thereby enabling any error caused between the value stored in the RAM 33 specifying a position range of each of symbol marks being rotated and the actual position of each of the stepping motors 55 to be eliminated for a full rotation.

The micro 30 is further connected with a reel stop signal circuit 45 and a payout completion signal circuit 46. The reel stop signal circuit 45 and the payout completion signal circuit 46 collectively constitute input signal generation means. The reel stop signal circuit 45 is designed to generate a stop signal to have the respective rotation reels 3, 4 and 5 stopped from rotating in response to the operation of the stop buttons 16, 17, and 18, respectively. The payout completion signal circuit 46 is connected with a medal sensing unit 47 for counting the number of game medals paid out from the hopper 38. The payout completion signal circuit 46 is designed to output a payout completion signal to the CPU 31 when the number of the game medals actually paid out, which is input from the medal sensing unit 47, reaches a predetermined value of the dividend rate.

The data stored in the ROM 32 includes sequence programs for game process procedures performed in the slot machine 1. In addition, the data stored in the ROM 32 includes data tables such as a prize probability table, a symbol mark table, and a winning symbol combination table indicative of relationships between symbol mark sets and the respective prize winnings.

The prize probability table includes data indicative of relationships between segment ranges of the random numbers generated by the random number generator 36 and the respective prize winning states. The prize probability table forms part of random number assigning means for assigning the random number sampled by the random number sampling circuit 37 to the respective segment range (hereinafter referred to as simply "segment") representing the prize winning state in reference to the prize probability table. The data contained in the prize probability table is best shown in FIG. 6. The segments of the expected random numbers are shown in FIG. 6 as being represented by data rows of alphanumeric characters: a1–a3, b1–b3, c1–c3, d1–d3, and e1–e3 in the data table. The random number assigning means assigns the random number sampled by the sampling circuit 37 to the corresponding prize winning state in reference to any of the data rows of the prize probability table. The insertion of one game medal in betting causes the random number assigning means to refer to the data raw of "a1–e1", the insertion of two game medals causes the random number assigning means to refer to the data raw of "a2–e2", the insertion of three game medals causes the random number assigning means to refer to the data raw of "a3–e3".

The segment of the prize probability table that the sampled random number belongs determines the prize winning state. The prize winning states are represented by six kinds of prize winning state flag, including "no-prize" and "replay" prize winning flags, respectively. The random number generator 36, the random number sampling circuit 37, the winning probability table, and the micom 30 collectively constitute the prize winning state determining means for determining a prize winning state based on random number lottery. As described hereinbefore, the stop control means for controlling the stop of the shift and display means to have a predetermined set of symbol marks shifted and displayed on the basis of the prize winning state determined by the prize winning state determining means. The prize winning states of each kind are generated at a predetermined probability according to the setting of the prize probability table. This leads to the fact that the total number of game medals paid out in a business day remains approximately the same regardless of the skill of the game players.

Each of the aforesaid alphanumeric characters specifies a value. The values, usually defined a<b<c<d<e<f<g in the ascending order of size, represent the respective segments representative of respective prize winning states as shown in FIG. 6. The sampled random number not greater than a causes the prize winning state determining means to request the big prize winning state (big hit), thereby setting up the BB winning flag. The sampled random number less than a but not greater than b causes the prize winning state determining means to request the middle prize winning state (middle hit), thereby setting up the "RB" prize winning flag. The sampled random number not less than b but not greater than d causes the prize winning state determining means to request the small prize winning state (small hit). In the case, the sampled random number not less than b but not greater than c sets up the "plums" prize winning flag, the sampled random number not less than c but not greater than d sets up the "bells" prize winning flag. The sampled random number not less than d but not greater than e causes the prize winning state determining means to request "replay" prize winning state, thereby setting up the "replay" winning flag. The sampled random number not less than e sets up no-prize winning flag.

In general, the game conditions include five types: "RB game operation", "regular game in BB operation", "regular game", "regular game in RB inner winning operation", and "regular game in BB inner winning operation".

"RB" means the aforesaid regular bonus game under which the game player can play a bonus game composed of a set of games with a plurality of predetermined high dividend rates. "RB operation" means the game condition under which the RB game is played, and the game player can win either no-prize or JAC prize. "BB" means the aforesaid big bonus game under which the game player can repeatedly play a set of the regular games and the aforesaid bonus games. "The regular game in BB operation" means that the regular game condition under which the BB game is played, and the game player can win the small prize at a high probability. The regular game condition" means that the game is played under neither of the aforesaid BB nor RB, in which neither RB nor BB prize winning flag is set up. The "regular game in RB inner winning operation" or "regular game in BB inner winning operation" means a regular condition under which the predetermined set of symbol marks representative of the RB prize or BB prize have not yet been stopped and displayed on the prize winning line, thereby resulting in that RB game or BB game has not started although RB prize winning flag or BB prize winning flag is set up.

The symbol mark table is best shown in FIG. 7. The symbol mark table is indicative of relationships between positions of each of the rotation reels 3, 4, and 5, and the respective symbol marks. Each symbol row of the rotation reels is represented by a code number of 0 to 20 indicating the position of the respective rotation reel and each symbol mark is represented by a symbol code of A to H. More specifically, the code numbers are allocated to the outer surface of each of the rotation reels 3, 4 and 5 equi-distantly spaced apart from one another with reference to the position at which the aforesaid reset pulse is generated. The symbol mark table is indicative of relationships between the code numbers representing the positions of each of the rotation reels 3, 4 and 5 and the symbol codes representing the respective symbol mark.

The winning symbol combination table includes a plurality of predetermined sets of symbol codes (symbol marks) which will be indicated in the dividend rate indication portion 22. The winning symbol combination table further includes a plurality of predetermined sets of symbol codes (symbol marks) representative of "li-zhi" state for notifying the game player that that the prize winning request is set for the special game condition, winning prize judging codes for indicating each of the winning prizes, and the numbers of game medals awarded for the respective winning states. At the times when any of the rotation reels 3, 4 and 5 is stopped from rotating, and when the all of the rotation reels 3, 4 and 5 are stopped from rotating, the winning prize is confirmed with reference to the winning symbol combination table.

In the present embodiment, the speaker 39, the speaker drive circuit 43 and the micom 30 as a whole constitute sound generation means which is operative to generate any one of game start sounds 1 and 2 as effect sound when the rotation reels 3 to 5 in the display start to rotate with the operation of the start lever 15. The kind of the game start sound thus generated by the aforesaid sound generation means is selected in the manner described in detail hereinafter.

Figure 8:
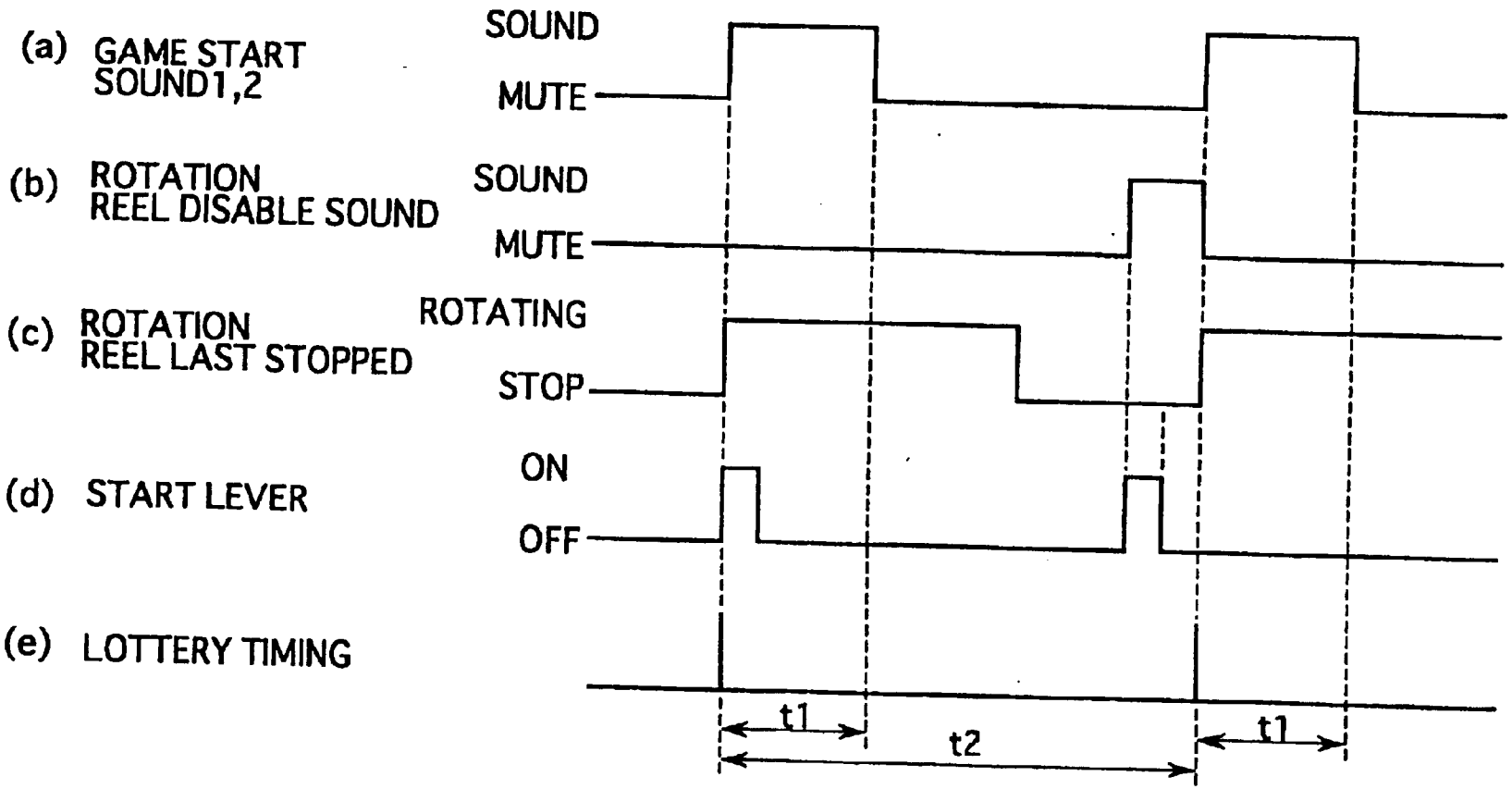
FIG. 8 is a timing chart showing times at which game starting sounds are processed to emit by a processing unit forming part of the slot machine according to the present invention.

The game start sounds 1 and 2 are generated at the time shown in FIG. 8(*a*) and output for the period of t1 immediately after the prize winning state lottery time (see FIG. 8(*e*)). The start lever 15 must be operated at an interval of t2, for instance, 4.1 seconds. The operation of the start lever 15 at an interval of less than t2 after the previous operation (see FIG. 8(*d*)), a rotation reel disable sound is output from the speaker 39 at the time shown in FIG. 8(*b*). FIG. 8(*c*) shows the rotating state of the rotation reel last stopped in the previous game. The last stopped rotation reel does not start to rotate until t2 elapses after the previous start. The game start sound is output in the subsequent game simultaneously with the start of the last stopped rotation reel at an interval of t2 after the previous start (see FIG. 8(*a*)).

Figure 9:
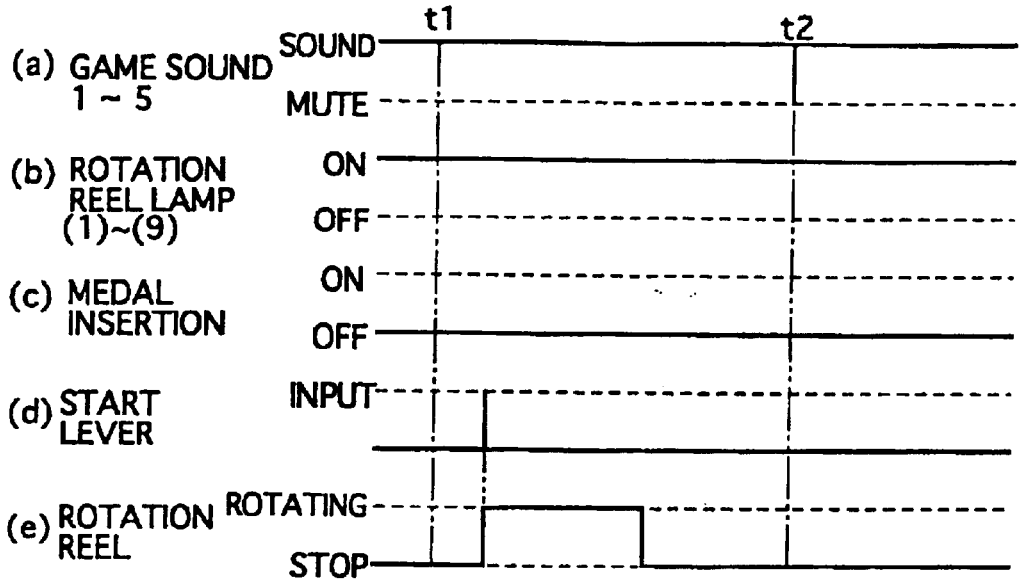
FIG. 9 is a timing chart showing a plurality of times at which a specific number of game sounds are processed to emit by a processing unit forming part of the slot machine according to the present invention.

In addition, the sound generation means forming part of notifying means is operated to notify the game player of predetermined notifying information in notifying states including a current notifying state and subsequent notifying states following said current notifying state, while the game player is enjoying games including a current game and subsequent games following said current game. In the embodiment, the notifying means outputs any one of five games sounds: game sound 1, game sound 2, game sound 3, game sound 4 and game sound 5 during the regular game operation. One game sound is selected from the game sounds 1 to 5 through a lottery operation run after the input time of the start lever 15 (see FIG. 9(*d*)) by subsequent notifying state determining means, which will be described hereinafter. Then the notifying means is operated to output the selected game sound (see FIG. 9(*a*)). More specifically, the game sound to be sounded in the subsequent game is selected in advance on the basis of the game sound sounded in the current game. The subsequent notifying state determining means is constituted by the micom 30.

The game sound 1, 2, 3, 4 or 5 is output continuously during one game. One game starts with the insertion of the first game medal in the Xth game and ends with the insertion of the game medal in the (X+1) th game. By the lottery operation, the type of the game sound to be selected in the subsequent games is selected, and then stored in the RAM 33 in each game. The sound generation means is operated to output the selected type of the game sound with reference to a value stored in the RAM 33 at the game medal insertion time (see FIG. 9(*c*)). The rotation reel lamps (1) to (9) are lighted on simultaneously with the game medal insertion time (see FIG. 9(*c*)). The rotation reels 3 to 5 start to rotate simultaneously with the start lever input time (see FIG. 9(*e*)).

As described hereinbefore, the game sound 1, 2, 3, 4 or 5 is output at the game medal insertion time. Any one of the game sounds 1 to 5 other than the current game sound is output at the game medal insertion time t2 at which the game sound is changed over. On the other hand, the same game sound continues without interruption at the medal insertion time t1 at which the game sound sounded in the current game is identical with the game sound to be sounded in the subsequent game. The game sound 1, 2, 3, 4 or 5 is output if the game sound is switched to mute at the game medal insertion time. As will be appreciated from the foregoing description, when the current notifying state in the current game is identical to the subsequent notifying states in said subsequent games, the notifying means (30, 39, 43) continues to notify the game player of the identical notifying state without interruption.

Figure 10:
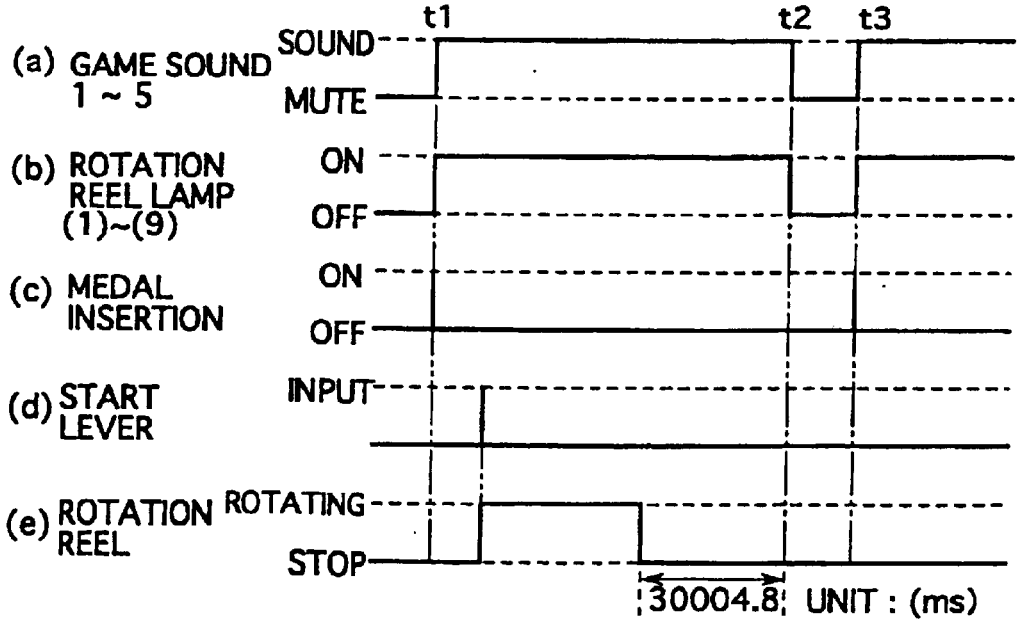
FIG. 10 is a timing chart showing a plurality of times at which game sounds are processed to emit and not to emit by a processing unit forming part of the slot machine according to the present invention.

Referring to the FIG. 10 of the drawing, there is shown a timing chart of a mute timing of the game sound 1, 2, 3, 4, or 5. The game sound 1, 2, 3, 4 or 5 starts to sound (see FIG. 10(*a*)) and the rotation reel lamps (1) to (9) are lighted (see FIG. 10(*b*)) on at the game medal insertion times t1 and t3 (see FIG. 10(*c*)). Then, the start lever 15 is operated at the time shown in FIG. 10(*d*), and the rotation reel lamps (1) to (9) are lighted off (see FIG. 10(*b*)) at the time t2 approximately 30 seconds after the rotation reels 3 to 5 are stopped from rotating (see FIG. 10(*e*)). Any one of the game sounds 1 to 5 currently being sounded is switched to mute at the light off time (see 10(*a*)).

The subsequent notifying state determining means is designed to determine and select the game sound to be sounded in the subsequent game (hereinafter simply referred to as "subsequent game sound") by the lottery operation in reference to the game sound sounded in the current game (hereinafter simply referred to as "current game sound"). That is, the subsequent determining means is operative to determine and select in advance the subsequent notifying states in the current game on the basis of the current notifying state to be informed by the notifying means. In FIG. 11, there is shown a table which indicates combinations of the current game sounds and the possible subsequent game sounds determined as a result of the lottery/selection. In the table there is stated a variation value which means the difference of the subsequent game sound number minus the current game number wherein game sound number means any one of the numbers 1 to 5 indicative of the game sounds 1 to 5.

The subsequent notifying state determining means selects the game sound 1, 2, 3, 4, or 5 under the three game conditions of "regular game", "regular game in RB inner winning operation", and "regular game in BB inner winning operation". Under game conditions of "RB game operation" and "regular game in BB operation" is sounded a working sound other than any of the game sounds 1 to 5.

Referring to a table in FIG. 12, the selection of the subsequent game sound (D) will be described in detail. Firstly, the variation value (C) is selected by the lottery operation on the basis of the current game condition (A) and the current game sound (B). The subsequent game sound (D) is determined as a result of the addition of the variation value (C) to the current game number. This leads to the fact that the same game sound will continue for a couple of games if the variation value (C) happens to be 0 for the games.

Referring to a table in FIG. 13, the lottery operation of the game sound 1, 2, 3, 4, or 5 will be described. The lottery operation of the game sound 1, 2, 3, 4, or 5 is performed after the prize winning state is determined through the probability lottery process by the prize winning state determining means in the current game. The slot machine includes a register which generates random numbers: discrete numbers of 0 to 127. In FIG. 13, there are shown game sound selection probability tables indicative of relationships between the game sounds and the respective segment ranges (hereinafter referred to as "segment") of numbers. The lottery operation of the game sound 1 to 5 is carried out by sampling a random number generated by the register at an arbitrary time. Then, the segment of the game sound selection probability table that the sampled random number belongs determines the subsequent game sound.

In FIG. 13(*a*) there is shown a game sound selection probability table having data used to select the subsequent game sound with the current game sound of game sound 1. In FIGS. 13(*b*), (*c*), (*d*), and (*e*), there are shown the game sound selection probability tables used to select the subsequent game sound with the current game sound of game sound 2, 3, 4 and 5, respectively. Every value stated in the tables is indicative of the numerator of the fraction with the denominator of 128 which is the total number of the random numbers. In FIG. 13(*a*) there is shown the probability table with the current game sound 1. For instance, the probability of the game sound 1 to be selected for the subsequent game sound under the "regular game" condition is 80/128. The probability of the game sound 5 to be selected for the subsequent game sound under the "regular game in BB inner winning operation" condition is 80/128.

Referring to the tables shown in FIG. 13, it is recognized that the game sound 4 is selected for the subsequent game sound only under the game condition of "regular game in RB inner winning operation", or "regular game in BB inner winning operation". This leads to the fact that the game player can confirm that the RB or BB inner winning is generated inside the machine by hearing the game sound 4. Similarly, the game sound 5 is selected for the subsequent game sound only under the game condition of "regular game in BB inner winning operation" so that the game player can confirm that the BB inner winning is generated inside the machine by hearing the game sound 5. The confirmation of the inner winning state made by the game sound is referred to as "inner winning confirmation". It is thus noted from the foregoing description, the notifying information notified by the notifying means is correspondent to specified prize winning state determined by the prize winning state determining means.

As described hereinbefore, the sound generation means constitutes notifying means for notifying of the game player of notifying information indicative of winning state determined by the prize winning state determining means, i.e., RB or BB inner winning state confirmation in this case. In addition, the game sound selection probability tables shown in FIG. 13 indicate that the game sound 4 or 5 is not always selected for the subsequent game sound under the game condition of RB or BB inner winning confirmation. In other words, the game sound 1, 2, or 3 may be selected for the subsequent game sound under such game condition. As a result of this, the notifying means serves to notify the game player of the probability of the generated inner winning state in addition to the inner winning state confirmation. As will be appreciated from the foregoing description that the notifying means is operative to notify the game player of said notifying state corresponding to said prize winning state at a predetermined probability.

For instance, in reference to FIG. 13(*a*), the probability of the game sound 5 to be selected for the subsequent game sound under the current game condition of "regular game in BB inner winning operation" with the current game sound of the game sound 1 is at 5/128. Similarly, in reference to FIG. 13(*d*), the probability of the game sound 4 to be selected for the subsequent game sound under the current game condition of "regular game in RB inner winning operation" with the current game sound of the game sound 4 is at 128/128, i.e., 100%. Furthermore, in reference to FIG. 13(*e*), the probability of the game sound 5 to be selected for the subsequent game sound under the current game condition of "regular game in BB inner winning operation" with the current game sound of the game sound 5 is at 128/128, i.e., 100%

In addition to the aforesaid notifying means for notifying the game sound 1 to 5, there is provided second notifying means. After the lottery process of the game sound 1 to 5, the notifying state of the second notifying means is determined in reference to the same variation value obtained in the aforesaid lottery process. The aforesaid sound generation means for generating two kinds of the game sounds 1 and 2, the rotation reel back lamps 57*a* to 57*c*, the lamp drive circuit 48, the game condition indication LED25, the LED drive circuit 42 and the micom 30 as a whole constitutes the second notifying means. The second notifying means is designed to notify the game player of notifying information in a current notifying state.

The notifying state in the current game (hereinafter referred to as "current notifying state") by the second notifying means is determined on the basis of the notifying state to be notified in the subsequent game (hereinafter referred to as "subsequent notifying state") determined by the subsequent notifying state determining means. The game start sound, the rotation reel back lamps 57 and the game condition indication LED25 are combined to perform an entertaining performance (hereinafter referred to as "entertainment") in accordance with the notifying state. This means that the entertainment is selected on the basis of the same variation value obtained in the lottery process for the subsequent game sound 1 to 5, i.e., on the basis of the subsequent notifying state. Simultaneously with the selection of the entertainment to be performed in the subsequent game, the four elements of the entertainment such as for example the game start sound, the movements of the first rotation reel 3, the second rotation reel 4, and the third rotation reel 5, respectively are selected to be operated.

In FIG. 14 there is shown a table showing the relationships between the game start sounds and the rotation reel lamp operation group numbers. The group numbers of 1 to 26 are assigned to the current game sound and six kinds of the prize winning flag. An entertainment pattern of the game start sound and rotation reel lamp operation is determined according to the variation value and the group number.

If the variation value of "−2" is determined by the subsequent notifying state determining means, for instance, the game sound 1 is selected for the subsequent game sound with the current game of the game sound 3 while the group number 2 is selected from among the group numbers shown in FIG. 14 with the "bells" prize winning flag currently set. Similarly, if the variation value of "+1" is determined by the subsequent notifying state determining means, the game sound 2 is selected for the subsequent game sound with the current game of the game sound 1 while the group number 18 is selected from among the group numbers shown in FIG. 14 with the "BB" prize winning flag currently set.

According to the group number of 1 to 26 obtained in the process of selecting the game start sound and rotation reel lamp operation group number; the game start sound and rotation reel lamp operation group number 1 to 26 is selected. In FIG. 15 to FIG. 24, there are shown tables specific to the game start sound and rotation reel lamp operation groups. In each of the tables, a lottery probability column is provided. Each lottery probability column is divided into segments. A random number of 0 to 255 generated by the register is sampled at an arbitrary time. Then, the segment of the lottery probability column that the sampled random number belongs determines the game start sound and rotation reel lamp operation pattern in the current game. Every value stated in the lottery probability column is the numerator of the fraction with the denominator of 256 which is total number of the probability.

If, for instance, the game start sound and rotation reel lamp operation group number 2 is selected from among the group numbers shown in FIG. 14 with the variation value of "−2" obtained and the "bells" prize winning flag set in the aforesaid case, the table specific to the game start sound and rotation reel lamp operation group 2 in FIG. 15(*b*) is referred to. In the case, for instance, a random number of "71" is thus sampled, the sampled random number of "71", greater than "50" of (25+25), a total of the probability values of the first and second columns and less than "100" of (25+25+25), a total of the probability values of the first to third columns, belongs to the third segment of the lottery probability column, representing the third game start sound and rotation reel lamp operation pattern. This leads to the fact that following game start sound and rotation reel lamp operation pattern is selected: the game start sound 1, the rotation reel lamp operation pattern 2 with the first rotation reel stopped, the rotation reel lamp operation pattern 1 with the second rotation reel stopped, and the rotation reel lamp operation pattern 1 with the third rotation reel stopped.

If, the game start sound and rotation reel lamp operation group number 18 is selected from among the group numbers shown in FIG. 14 with the variation value of "+1" obtained and the "BB" prize winning flag set in the aforesaid case, the table specific to the game start sound and rotation reel lamp operation group 18 in FIG. 19(*r*) is referred to. In the case, for instance, a random number of "123" is thus sampled, the sampled random number of "123", greater than "100" of (50+50), a total of the probability values of first and second columns and less than "150" of (50+50+50), a total of the probability values of the first to third columns, belongs to the third segment of the lottery probability column, representing third game start sound and rotation reel lamp operation pattern is selected from among the patterns shown in FIG. 19(*r*). This leads to the fact that following game start sound and rotation reel lamp operation pattern is selected: the game start sound 1, the rotation reel lamp operation pattern 1 with the first rotation reel stopped, the rotation reel lamp operation pattern 3 with the second rotation reel stopped, and the rotation reel lamp operation pattern 3 with the third rotation reel stopped.

There are provided five types of rotation reel lamp operation patterns including rotation reel lamp operation patterns 0 to 4. In FIGS. 25 to 28 there are shown tables indicating the rotation reel lamp operation patterns 0 to 4. As described hereinbefore, the back lamps 57*a* arranged on the upper line of the rotation reels 3, 4, and 5 are shown in "flash pattern" columns as being represented by the circles (1), (2) and (3), respectively. Similarly, the back lamps 57*b* arranged on the intermediate line of the rotation reels 3, 4 and 5 are shown in the "flash pattern" columns as being represented by the circles (4), (5) and (6), respectively. The back lamps 57*c* arranged on the lower line of the rotation reels 3, 4 and 5 are also shown in the "flash pattern" columns as being represented by the circles (7), (8) and (9), respectively. The light on state of the lamp is represented by diagonally shaded areas while the light off state is represented by non-shaded areas. The tables each includes a "stage" column which represents an elapse of time. Each of the back lamps 57*a* to 57*c* is switched on and off at intervals of the stage, for instance, of 75.2 msec.

In FIG. 25 there is shown the operation pattern 0 in which each of the lighted back lamps 57*a* to 57*c* on the first rotation reel 3 moves downward twice as shown in the operation pattern 3 of the rotation reel lamp operation pattern table in FIG. 29. In FIG. 26 there is shown the operation pattern 1 in which each of the lighted back lamps 57*a* to 57*c* on the first rotation reel 3 moves downward once as shown in the operation pattern 1 of the rotation reel lamp operation pattern table in FIG. 29. The operation pattern 2 has each of the lighted back lamps 57*a* to 57*c* on the first rotation reel 3 not move as shown in the operation pattern 2 of the rotation reel lamp operation pattern table in FIG. 29. In FIG. 27 there is shown the operation pattern 3 in which each of the lighted back lamps 57*a* to 57*c* on the first rotation reel 3 moves upward once as shown in the operation pattern 3 of the rotation reel lamp operation pattern table in FIG. 29. In FIG. 28 there is shown the operation pattern 4 in which each of the lighted back lamps 57*a* to 57*c* on the first rotation reel 3 moves upward twice as shown in the operation pattern 4 of the rotation reel lamp operation pattern table in FIG. 29.

The downward and upward move of each of the lighted back lamps 57*a* to 57*c* on the first rotation reel 3 corresponds to the difference of the subsequent game sound number minus the current game sound number, i.e., the variation value.

The game machine further comprises second notifying state determining means constituted by the micom 30. As will be appreciated from the foregoing description, the micom 30 serves as the subsequent notifying state determining means and the second notifying state determining means. The second notifying state determining means is operated to determine and select in advance the current notifying states on the basis of the subsequent notifying states determined by the subsequent notifying state determining means. For instance, in the aforesaid example, if the game start sound and rotation reel lamp operation group number 2 is selected from among the group numbers shown in FIG. 14 with the variation value of "−2" obtained and the "bells" prize winning flag set and then, the random number of "71" is sampled, the rotation reel lamp operation pattern 2 with the first rotation reel stopped, the rotation reel lamp operation pattern 1 with the second rotation reel stopped, and the rotation reel lamp operation pattern 1 with the third rotation reel stopped are selected by the second notifying state determining means. In the case, no entertainment is made by the rotation reel lamps with the first rotation reel 3 stopped in the current game, the back lamps 57*a* to 57*c* of the first rotation reel 3 move downward once (−1) with the second rotation reel 4 stopped, the back lamps 57*a* to 57*c* of the first rotation reel 3 move downward once (−1) with the third rotation reel 5 stopped. The downward movement is thus performed twice (−1 −1=−2) by the entertainment of the rotation reel lamp in the current game, thereby notifying the game player of the variation value of "−2".

If the game start sound and rotation reel lamp operation group number 18 is selected from among the group numbers shown in FIG. 14 with the variation value of "+1" obtained and the "BB" prize winning flag set and the random number of "123" is sampled in the aforesaid case, the rotation reel lamp operation pattern 1 with the first rotation reel stopped, the rotation reel lamp operation pattern 3 with the second rotation reel stopped, and the rotation reel lamp operation plate 3 with the third rotation reel stopped are selected by the second notifying state determining means. In the case, the back lamps 57*a* to 57*c* of the first rotation reel 3 move downward once (−1) with the first rotation reel 3 stopped, the back lamps 57*a* to 57*c* of the first rotation reel 3 move upward once (+1) with the second rotation reel 4 stopped, the back lamps 57*a* to 57*c* of the first rotation reel 3 move upward once (+1) with the third rotation reel 5 stopped. The upward movement is thus performed once (−1+1+1=+1) by the entertainment of the rotation reel lamp in the current game, thereby notifying the game player of the variation value of "+1".

Figure 30:
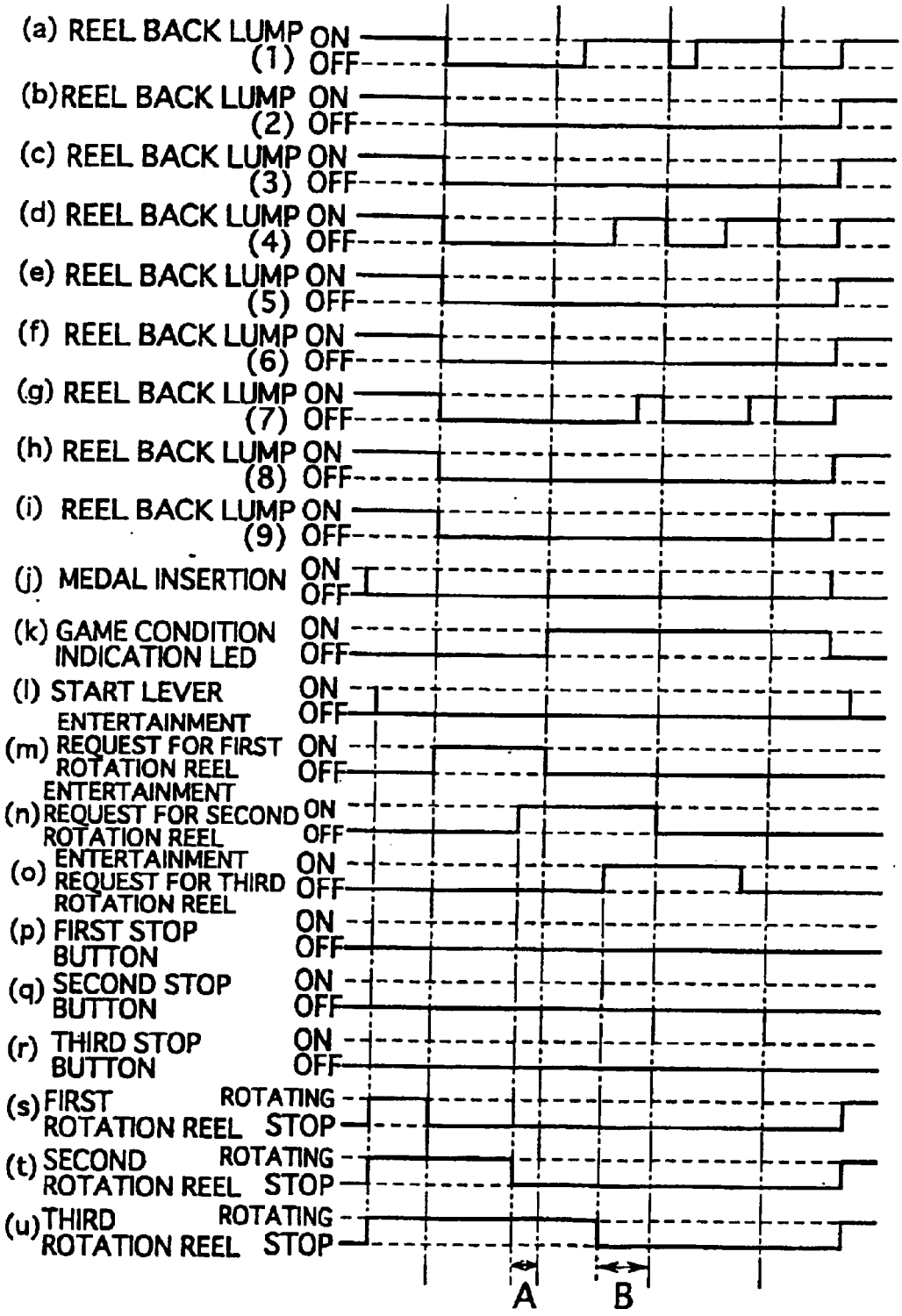
FIG. 30 is a timing chart showing the times of the rotation reel lamps, the game condition indication LED, and other constitutional elements or parts forming an electric circuit of the processing unit forming part of the slot machine according to the present invention, FIGS. 31(*a*) to (*c*) are tables each showing the relationships between the rotation reel lamp operation pattern and the game condition indication LED pattern which are used in the process of the processing unit forming part of the slot machine according to the present invention.

Referring to FIG. 30 of the drawing, there are shown timing charts of entertainments performed by the rotation reel back lamps (1) to (9) and the game condition indication LED25.

The insertion of game medal into the medal inserting slot 9 at the time shown in FIG. 30(*j*) permits the rotation reel back lamps (1) to (9) to be lighted on at the same time shown in FIGS. 30(*a*) to (*i*). Then, the start lever 15 is operated at the time shown in the FIG. 30(*l*), resulting in that the first, second and third rotation reels 3, 4, and 5 start to rotate simultaneously at the same time shown in FIGS. 30(*s*), (*t*) and (*u*). With the operation of the first stop button 16, the second stop button 17, and the third stop button 18 sequentially at the times shown in FIGS. 30(*p*), (*q*), and (*r*), the first, second and third rotation reels 3, 4, and 5 are stopped from rotating in response to the respective stop buttons as shown in FIGS. 30(*s*), (*t*), and (*u*).

In the rotation reel stop control operation of the aforesaid case, the first rotation reel stop button 16, the second rotation reel stop button 17, and the third rotation reel stop button 18 are operated sequentially at the times shown in FIGS. 30(*p*), (*q*), and (*r*), and the first, second and third rotation reels 3, 4, and 5 are stopped from rotating in the same order as shown in FIGS. 30(*s*), (*t*), and (*u*). However, the stop sequence of the first, second and third rotation reels 3, 4, and 5 is not limited to the embodiment. The first, second and third rotation reels 3, 4, and 5 may be stopped from rotating with a random operation of the stop buttons 16, 17, and 18. For instance, the fist, second and third rotation reels may be stopped from rotating sequentially in response to an operation sequence of the first rotation reel stop button 16, the third rotation reel stop button 18 and the second rotation reel stop button 17.

In the aforesaid case that the game start sound and rotation reel lamp operation group number 2 is selected from among the group numbers shown in FIG. 14 with the variation value of "−2" obtained and the "bells" prize winning flag set, the entertainment of the rotation reel lamps is performed in the following manner. Entertainment request for the first rotation reel is turned on at the stop time of the first rotation reel 3 as shown in FIG. 30(*m*), and the rotation reel back lamps (1) to (9) are operated to perform entertainment with the rotation reel lamp operation pattern 2. With the operation pattern 2, no entertainment is performed as described hereinbefore, and the rotation reel back lamps (1) to (9) remain to be lighted off as shown in FIGS. 30(*a*) to (*i*).

Entertainment request for the second rotation reel is turned on at the stop time of the second rotation reel 4 as shown in FIG. 30(*n*). On the other hand the entertainment of the second rotation reel is not performed during the period of A in which the entertainment of the first rotation reel is not completed. The entertainment of the first rotation reel is completed, thereby enabling the entertainment of the second rotation reel to be performed with the operation pattern 1 as shown in FIGS. 30(*a*) to (*i*). All the rotation reel back lamps (1) to (9) are lighted off in the first 75.2 msec, and then only the rotation reel back lamp (1) is lighted on in the subsequent 75.2 msec. In the following 75.2 msec, the rotation reel back lamps (1) and (9) are lighted on, and then the rotation reel back lamps (1), (4), and (7) are lighted on in the subsequent 75.2 msec.

Entertainment request for the third rotation reel is turned on at the stop time of the third rotation reel 5 as shown in FIG. 30(*o*). On the other hand the entertainment of the third rotation reel is not performed during the period of B in which the entertainment of the second rotation reel is not completed. The entertainment of the second rotation reel is completed, thereby enabling the entertainment of the third rotation reel to be performed with the operation pattern 1 as shown in FIGS. 30(*a*) to (*i*) in a similar fashion described hereinbefore.

The game condition indication LED 25 is operated in five patterns. The entertainment operation pattern of the game condition indication LED25 is updated according to the rotation reel lamp operation in reference to the game condition indication LED operation pattern table shown in FIG. 31(*a*) when the rotation reel lamp operation ends. There are provided five rotation reel lamp operation patterns: 0 to 4. Assuming that "rotation reel lamp operation pattern number" with the first rotation reel stopped is "n1", "n1" takes any value of 0, 1, 2, 3, and 4 in accordance with the first rotation reel lamp operation pattern 0, 1, 2, 3, or 4. Similarly, assuming that "rotation reel operation pattern numbers" with the second rotation reel stopped and "rotation reel lamp operation pattern number" with the third rotation reel stopped are "n2" and "n3", respectively, each of "n2", and "n3" takes any value of 0, 1, 2, 3, or 4 in accordance with the second and third rotation reel lamp operation pattern 0, 1, 2, 3, or 4.

The second notifying state determining means is operated to add the value of "rotation reel lamp operation pattern −2" to the value of "rotation real lamp operation pattern" every time when each of the rotation reel lamp operation ends. With the first rotation reel stopped, the value of "rotation reel lamp operation pattern −2" is "n1−2" and the value of "total of rotation reel lamp operation pattern −2" is "n1−2", thereby resulting in that the value of "rotation reel lamp operation pattern −2" equal to the value of "total of rotation reel lamp operation pattern −2". With "n1−2=S1", the operation of the game condition indication LED 25 corresponds to the value of S1. On the other hand, with the second rotation reel stopped, the value of "rotation reel lamp operation pattern −2" is "n2−2" and the value of "total of rotation reel lamp operation pattern −2" is "(n1−2)+(n2−2)=n1+n2−4". With "n1+n2−4=S2", the operation of the game condition indication LED 25 corresponds to the value of S2.

With the third rotation reel stopped, the value of "rotation reel lamp operation pattern −2" is "n3−2" and the value of "total of rotation reel lamp operation pattern −2" is "(n1−2)+(n2−2)+(n3−2)=n1+n2+n3−6". With "n1+n2+n3−6=S3", the operation of the game condition indication LED 25 corresponds to the value of S3. The operation of the game condition indication LED 25 is cleared with game medal inserted in the subsequent game.

Each value of "n1", "n2", and "n3" is in the range of 0 to 4, thereby resulting in that each value of "n1−2", "n2−2" and "n3−2" belongs to the range of −2 to 2. In the same manner, the facts that value of "n1+n2−4S2" is in the range of −4 to 4, and that the value of "n1+n2+n3−6=S3" is in the range of −6 to 6 are concluded.

A table shown in FIG. 31(*b*) indicates relationships between "total of rotation reel lamp operation pattern −2" and "game condition indication LED operation pattern". With the value of "total of rotation reel lamp operation pattern −2" not greater than 0, "game condition indication LED operation pattern" results in pattern 0. With the value of "total of rotation reel lamp operation pattern −2" of "1", "2", or "3", "game condition indication LED operation pattern" results in pattern 1, 2, or 3, respectively. Furthermore, with the value of "total of rotation reel lamp operation pattern −2" not less than 4, "game condition indication LED operation pattern" results in pattern 4.

Referring to FIGS. 32 to 36, there are shown game condition indication LED operation patterns 0 to 4. LEDs (A) to (H) integrated in the game condition indication LED 25 are shown in the "flash pattern" columns as being represented by the circles (A) to (H), respectively. As described hereinbefore, the LEDs (A) and (B) are housed in the left sections 25*a* and 25*b*, while the four LEDs (C), (D), (E), and (F) housed in the central section 25*c*, the LEDs (G)

and (H) are housed in the right sections 25*d* and 25*e*. The light on state of the LEDs (A) to (G) is represented by diagonally shaded areas while the light off state of the LEDs (A) to (G) is represented by non-shaded areas. Each table includes a "stage" column which represents an elapse of time. Each of the LEDs (A) to (H) is switched on and off at intervals of the stage, for instance, 80.48 msec as shown in FIGS. 32 to 36.

In FIG. 32, there is shown the operation pattern 0 of the game condition indication LED 25 in which the LED 25 of LEDs (A) to (H) remains lighted off at each stage with no entertainment performed. In FIG. 33, there is shown the operation pattern 1 of the game condition indication LED 25 in which the LED 25 up to the position of the LED (B) i.e., the second left section of 25*b* is lighted on. In FIG. 34, there is shown the operation pattern 2 of the game condition indication LED 25 in which the LED 25 up to position of the LEDs (C) to (F) i.e., the third central section of 25*c* is lighted on. In FIG. 35, there is shown the operation pattern 3 of the game condition indication LED 25 in which the LED 25 up to the position of the LED (G) i.e., the fourth left section 25*d* is lighted on. In FIG. 36, there is shown the operation pattern 4 of the game condition indication LED 25 in which the LED 25 up to the position of the LED (H), i.e., the fifth right section of 25*e* is lighted on.

A table shown in FIG. 31(*c*) indicates examples of the entertainment operation of the game condition indication LED 25, in which each of the rotation reel back lamps (1) to (9) is operated to perform the entertainment operation following rotation reel lamp operation pattern 4 with the first rotation reel 3 stopped at the first stop time, thereby resulting in that the value of "rotation reel lamp operation pattern −2" i.e., 4−2 comes to be 2 and that the value of "total of rotation reel lamp operation pattern −2" comes to be 2. As a consequence of this, "game condition indication LED operation pattern" becomes pattern 2. The entertainment of the game condition indication LED 25 following the pattern 2 is performed as shown in FIG. 30(*k*) from the time when the entertainment request for the first rotation reel is turned off (see FIG. 30(*m*)) until the time when the entertainment request for the second rotation reel is turned off (see FIG. 30(*n*)).

Each of the rotation reel back lamps (1) to (9) is operated to perform the entertainment operation following the rotation reel lamp operation pattern 1 with the second rotation reel 4 stopped at the second stop time, thereby resulting in that the value of "rotation reel lamp operation pattern −2" i.e., 1−2 comes to be −1 and that the value of "total of rotation reel lamp operation pattern −2", i.e., 2−1 comes to be 1. As a consequence of this, "game condition indication LED operation pattern" becomes pattern 1. The entertainment of the game condition indication LED 25 following the pattern 1 is performed as shown in FIG. 30(*k*) from the time when the entertainment request for the second rotation reel is turned off shown in FIG. 30(*n*) until the time when the entertainment request for the third rotation reel is turned off shown in FIG. 30(*o*).

Each of the rotation reel back lamps (1) to (9) is operated to perform the entertainment operation following rotation reel lamp operation pattern 2 with the third rotation reel 5 stopped at the third stop time, thereby resulting in that the value of "rotation reel lamp operation pattern −2" i.e., 2−2 comes to be 0 and that the value of "total of rotation reel lamp operation pattern −2", i.e., 2−1+0 becomes to be 1. As a consequence of this, "game condition indication LED operation pattern" becomes pattern 1. The entertainment of the game condition indication LED 25 following the pattern 1 is performed as shown in FIG. 30(*k*) from the time when the entertainment request for the third rotation reel is turned off (see FIG. 30(*o*)). The game condition indication by the game condition indication LED 25 is cleared at the game medal insertion time in the subsequent game.

The aforesaid game condition indication by the game condition indication LED 25 is performed in accordance with the difference of the subsequent game sound number minus the current game sound number, i.e., the variation value in the same manner as the entertainment indication by the rotation reel back lamps (1) to (9). This leads to the fact that the game condition indication LED 25 of LEDs (A) to (H) is lighted on increasingly extending in the right direction with the larger variation value while the game condition indication LED 25 of LEDs (A) to (H) is lighted on the less extending in the right direction with the smaller variation value The prize winning indication lamp 24 is lighted on with bonus condition satisfied. The bonus condition includes two requirements: one requirement that any of specified combination patterns of "the game start sound and the rotation reel lamp operation" is performed and the other requirement is that any of specified game sounds is output in the subsequent game. In other words, the prize winning indication lamp 24 is lighted on at the confirmation operation time in accordance with two requirements of the bonus condition completed.

In FIG. 37 there is shown the specified combination patterns of "the game start sound and the rotation reel lamp operation", which are entertaining combinations of the game start sound and the rotation reel lamp operation generated only under the game condition of the BB or RB inner winning operation. The specified game sounds include game sound 4 and game sound 5.

As described beforehand, with the bonus condition satisfied, the prize winning indication lamp 24 is lighted on at the confirmation operation time in accordance with the satisfied condition and not lighted off until the BB or RB game starts.

Figure 38:
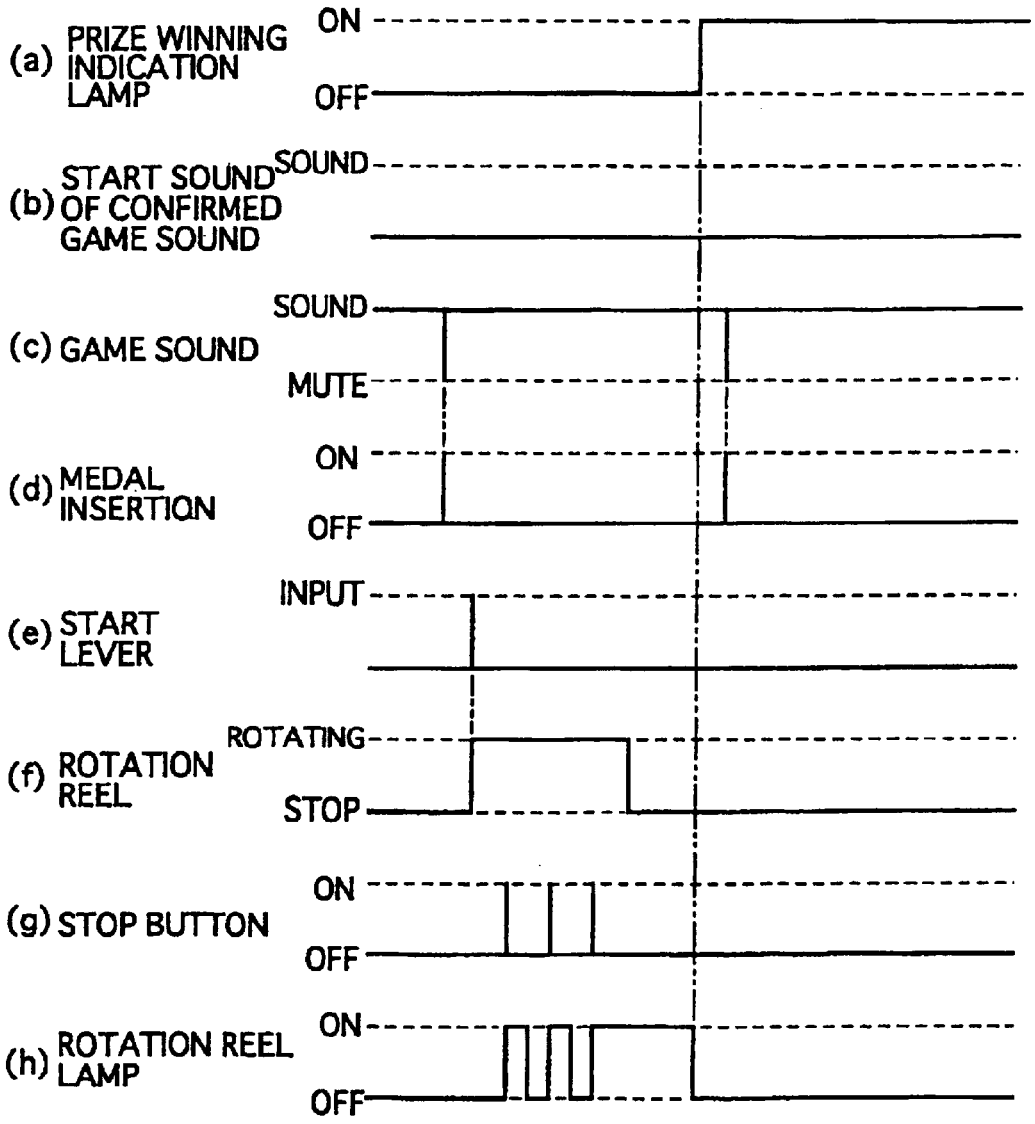
FIG. 38 is a timing chart showing the first lighting times of the prize winning indication lamps used in the process of the processing unit forming part of the slot machine according to the present invention.

This means that any of the specified combination patterns of "game start sound and rotation reel lamp operation" performed, thereby causing that the prize winning indication lamp 24 is lighted on (see FIG. (38(*a*)) with all the rotation reels 3 to 5 stopped (see FIG. 38(*f*)) at the time when the entertainment of the rotation reel lamps (1) to (9) ends (see FIG. 38(*h*)). Here, whether the specified combination pattern of "game start sound and rotation reel lamp operation" is performed or not is judged simply by the comparison with the patterns shown in FIG. 37. The rotation of each of the rotation reels 3 to 5 (see FIG. 38(*f*)) is started at the input time of the start lever 15 (see FIG. 38(*e*)) and stopped in response to the operation of the stop buttons 16, 17 and 18 (see FIG. 38(*g*)). The entertainment operation of the rotation reel lamps (1) to (9) is performed in response to the respective stop buttons 16, 17 and 18 (see FIG. 38(*h*)) as described hereinbefore. The game sound 1 to 5 (see FIG. 38(*c*)) is switched over at each time when game medal is inserted (see FIG. 38(*d*)). In this example, start sound of confirmed game sound is not output (see FIG. 38(*b*)).

Figure 39:
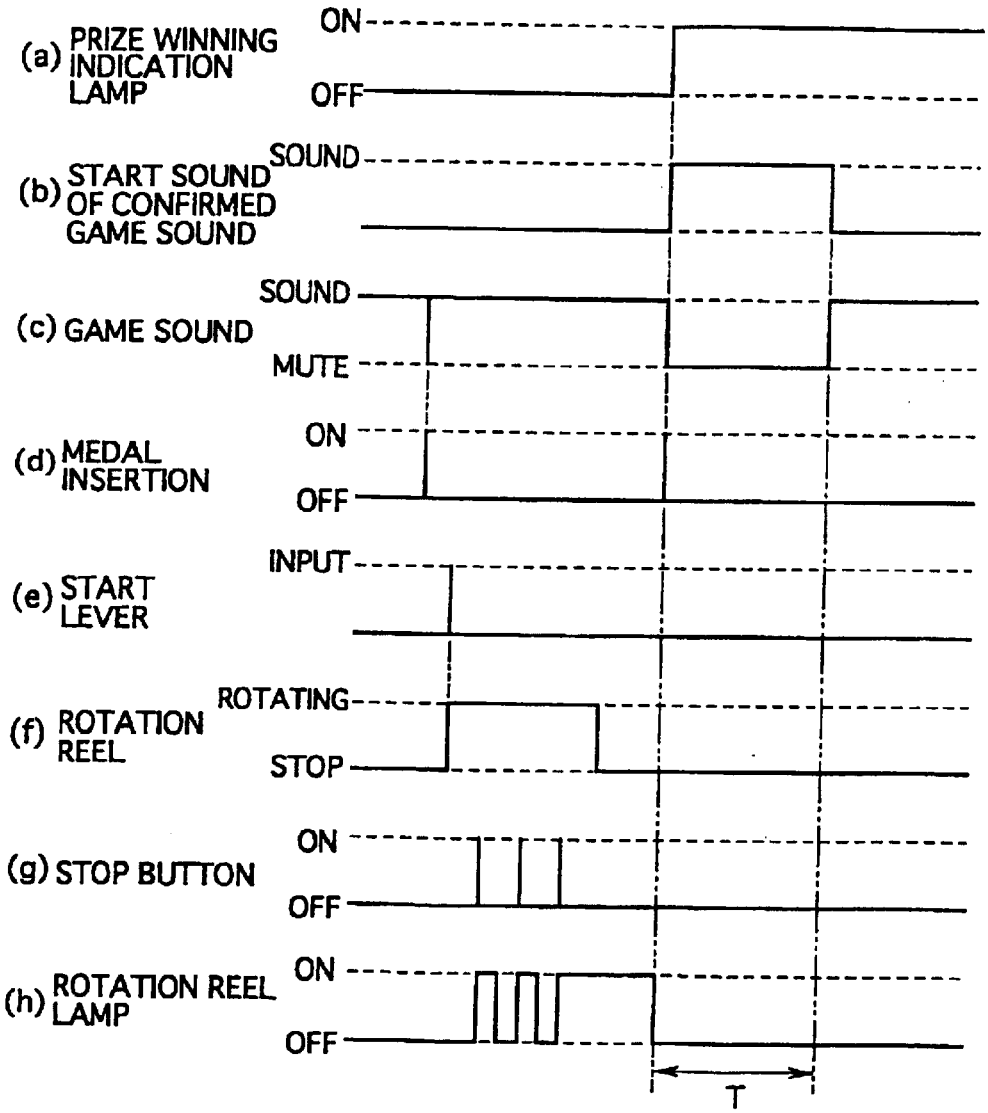
FIG. 39 is a timing chart showing the second lighting times of the prize winning indication lamps used in the process of the processing unit forming part of the slot machine according to the present invention.

With the specified game sound 4 or 5 output, the prize winning indication lamp 24 is lighted on (see FIG. 39(*a*)) at the time when the first game medal is inserted for the subsequent game (see FIG. 39(*d*)). At this time, the start sound of confirmed game sound is once output (see FIG. 39(*b*)). The priority of the start sound of confirmed game sound is higher than that of the game sound 4 or 5. This leads to the fact that the game sound 4 or 5 is not output during the period T in which the start sound of the confirmed game sound is output (see FIG. 39(*c*)).

Figure 40:
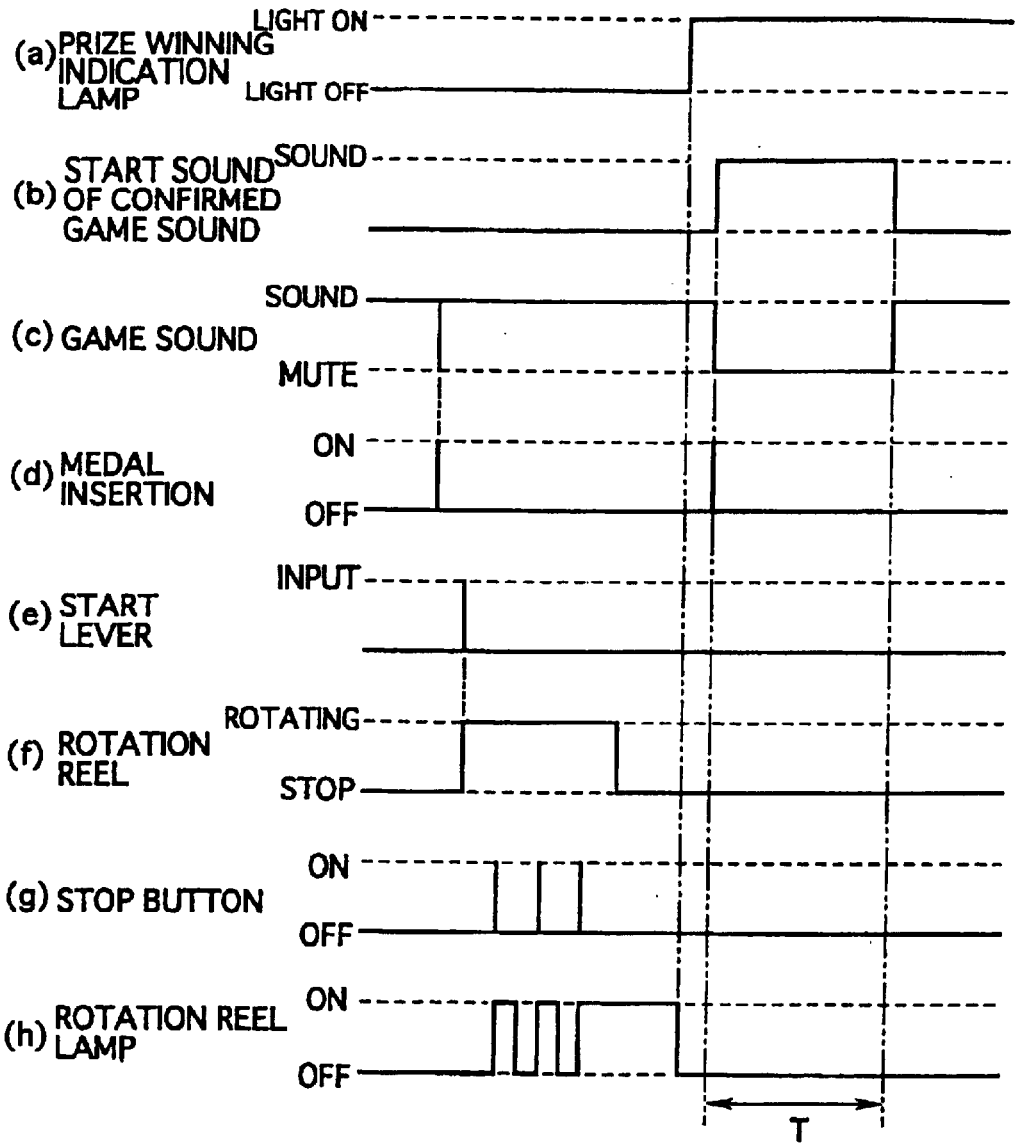
FIG. 40 is a timing chart showing the third lighting times of the prize winning indication lamps used in the process of the processing unit forming part of the slot machine according to the present invention.

With any of the specified combinations of "game start sound and rotation reel lamp operation" is performed, and with any of the specified game sound 4 or 5 output in the subsequent game, the prize winning indication lamp 24 is lighted on (see FIG. 40 (*a*)) after the entertainment operation of the rotation reel lamps (1) to (9) ends (see FIG. 40(*h*)). Then, the start sound of confirmed game sound is once output at (see FIG. 40(*b*)) at the time when the first game medal is inserted (see FIG. 40(*d*)).

Figure 41:
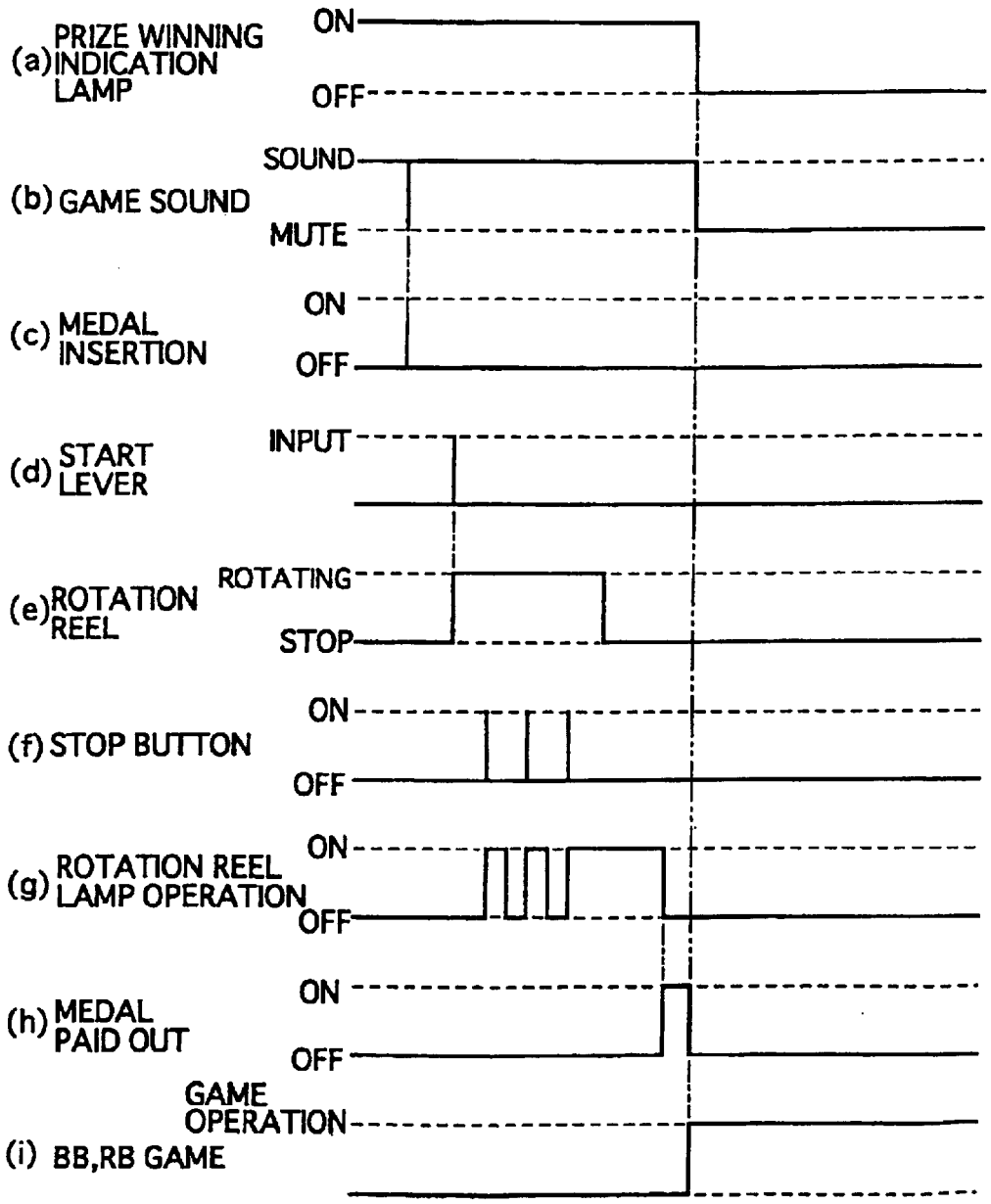
FIG. 41 is a timing chart showing the turning-off time of the prize winning indication lamp used in the process of the processing unit forming part of the slot machine according to the present invention.

Regardless of the requirements of the satisfied bonus condition, with which the prize winning indication lamp 24 is lighted on, the prize winning indication lamp 24 is lighted off at the same time shown in the timing chart in FIG. 41. This means that the prize winning indication lamp 24 is lighted off (see FIG. 41(*a*)) at the time when BB or RB game operation ends (see FIG. 41(*i*)) after the game medal is paid out (see FIG. 41(*h*)). At this time, the game sound stops (see FIG. 41(*b*)).

The operation of the micom 30 of the preferred embodiment according to the present invention will be described hereinafter.

Figure 44:
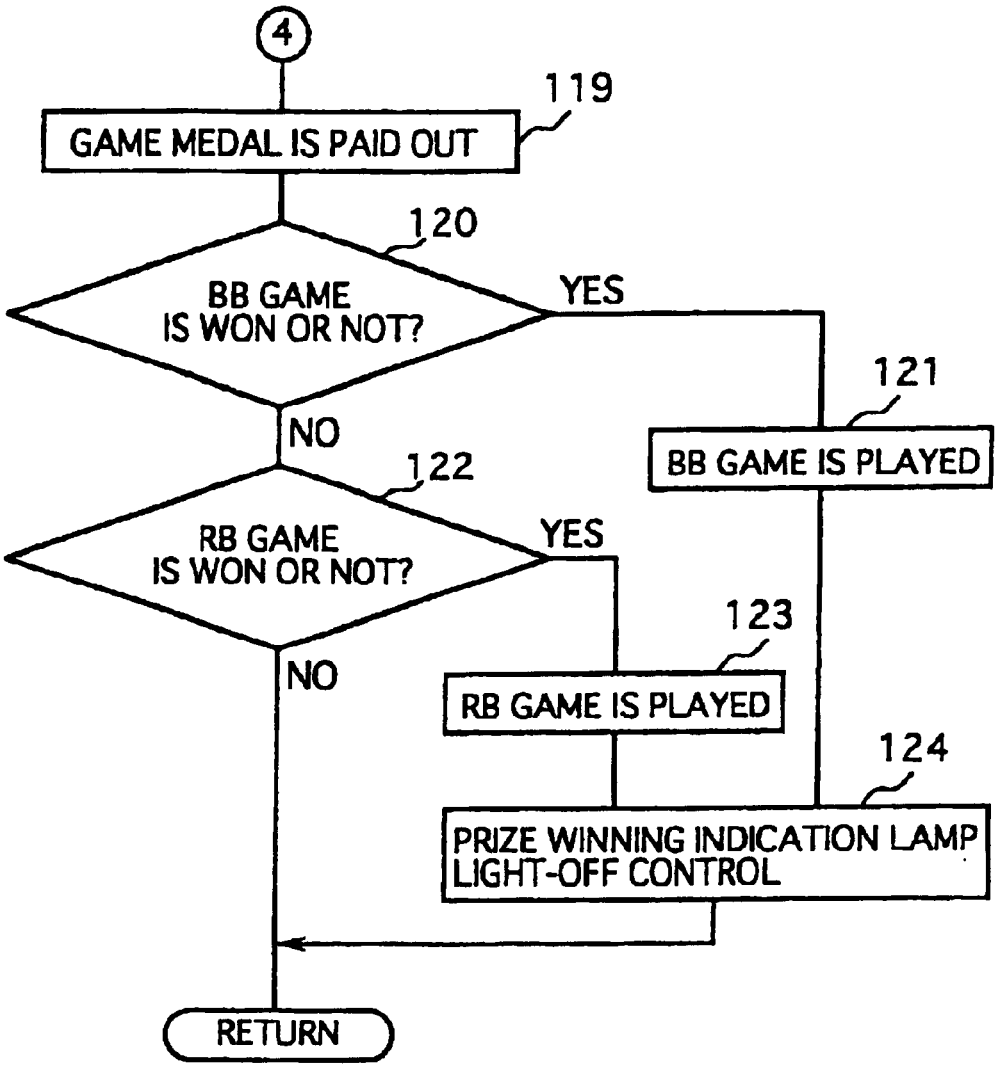
FIG. 44 is a third flow chart partly showing the process of the processing unit forming part of the slot machine according to the present invention.

The micom 30 is operated to control the game machine having the steps shown in FIGS. 42 and 44 as follows.

Figure 42:
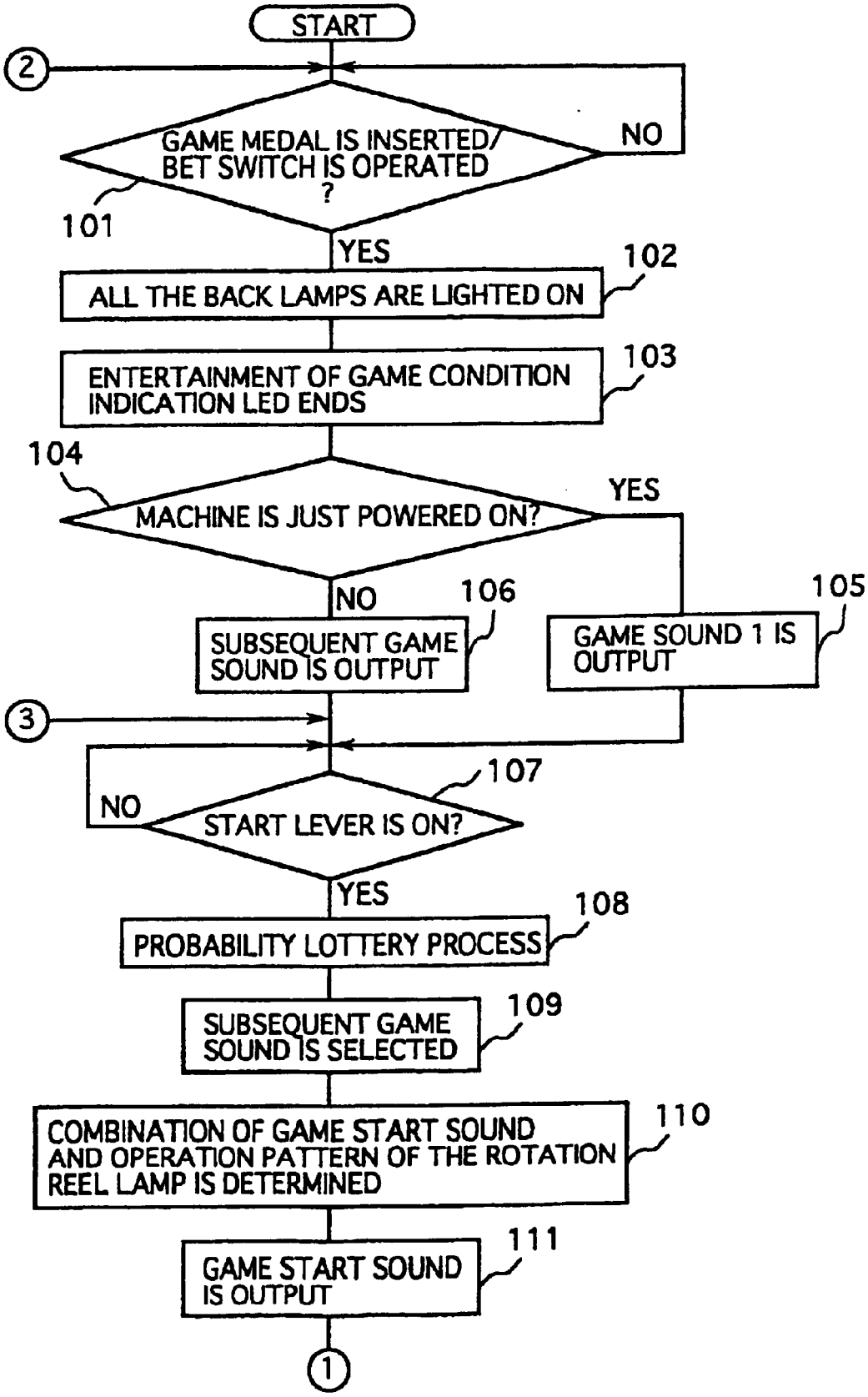
FIG. 42 is a first flow chart partly showing the process of the processing unit forming part of the slot machine according to the present invention.

Firstly, the judgment is made by the CPU 31 upon whether game medal is inserted/BET switch is operated or not (see FIG. 42, step S101,). In other words, in the step S101, the judgment is made by the CPU 31 upon whether a signal from the medal sensor 9S for having sensed the insertion of the game medal(s) into the medal inserting slot 9 or a signal from the Bet switch 10, 11, or 12 for having game medal(s) invested in betting is received or not. If the judgment is made by the CPU 31 YES, the step S101 proceeds to the step S102 wherein all the back lamps 57*a*, 57*b* and 57*c* are lighted on by the lamp drive circuit 48 following the instruction of the CPU31 (S102). The game condition indication LED 25 stops performing entertainment if the entertainment is in process (S103).

In the step S104, the judgment is by the CPU 31 upon whether the game process is performed for the first time since the slot machine 1 is turned on or not (S104). If the judgment is made by the CPU 31 that the game process is performed for the first time since the slot machine 1 is turned on, the step S104 goes forward to the step S105 wherein the speaker drive circuit 43 is controlled by the CPU 31 and the game sound 1 is output from the speaker 39 as an initial game sound (S105). Otherwise, the step S104 goes forward to the step S106 wherein one of the game sounds 1 to 5 selected for the subsequent game sound by the notifying state determining means in the previous game is output as a current game sound (S106). The subsequent game sound is selected from the game sounds 1 to 5 in the step S109, which will be described hereinafter, and output from the sound penetrating hole 19 on the lower and front side of the front panel, thereby enabling the game player to hear it.

In the step S107, the judgment is made by the CPU 31 upon whether the start lever 15 is operated or not, in reference to an input signal transmitted from the start switch 15S (S107).

If the judgment is made by the CPU 31 that the start lever 42 is operated, the step S107 goes forward to the step S108 wherein the prize winning state is determined by the prize winning state determining means (probability lottery process)(S108). As described hereinbefore, the segment of the prize probability table (see FIG. 6) which the random number sampled by the random number sampling circuit 37 belongs to determines the prize winning state in the probability lottery process. The prize winning state determined by the prize winning state determining causes the corresponding prize winning request flag to be setup. There are provided six types of the winning request flags such as "no-prize", "replay", "bells", "plums", "RB", and "BB". One of the aforesaid winning request flags is set in the predetermined area of the RAM33.

When the prize winning state is determined by the prize winning state determining means, the step S108 goes forward to the step S109 wherein the subsequent game sound 1 to 5 is selected (S109). As described hereinbefore, the subsequent game sound is determined in reference to the game sound lottery table as shown in FIG. 13 as follows. Firstly, the variation value is determined by lottery on the basis of the random numbers of 0 to 127 output from the register. Secondly, the subsequent game sound is determined in reference to the variation value.

The step S109 goes forward to the step S110 wherein the combination of the game start sound and the operation pattern of the rotation reel back lamps (1) to (9) is determined by the second notifying state determining means (S110). As stated hereinbefore, the operation pattern is determined in the following manner. Firstly, in reference to the table for selecting the game start sound and the rotation reel lamp operation group number shown in FIG. 14, the corresponding group number is selected from the numbers of 1 to 26 on the basis of the variation value used for determining the subsequent game sound, and the current game sound. Secondly, in reference to the table for selecting game start sound and rotation reel lamp operation group 1 to 26 shown in FIGS. 15 to 24, the current game start sound and rotation reel lamp operation pattern are determined on the basis of the previously selected number by lottery using the random number of 0 to 255 output from the register.

In the step S111, the speaker drive circuit 43 is controlled by the CPU and the game start sound 1 or 2 determined in the step S110 is output through the speaker 39 at the time specified in FIG. 8 (S111).

Figure 45:
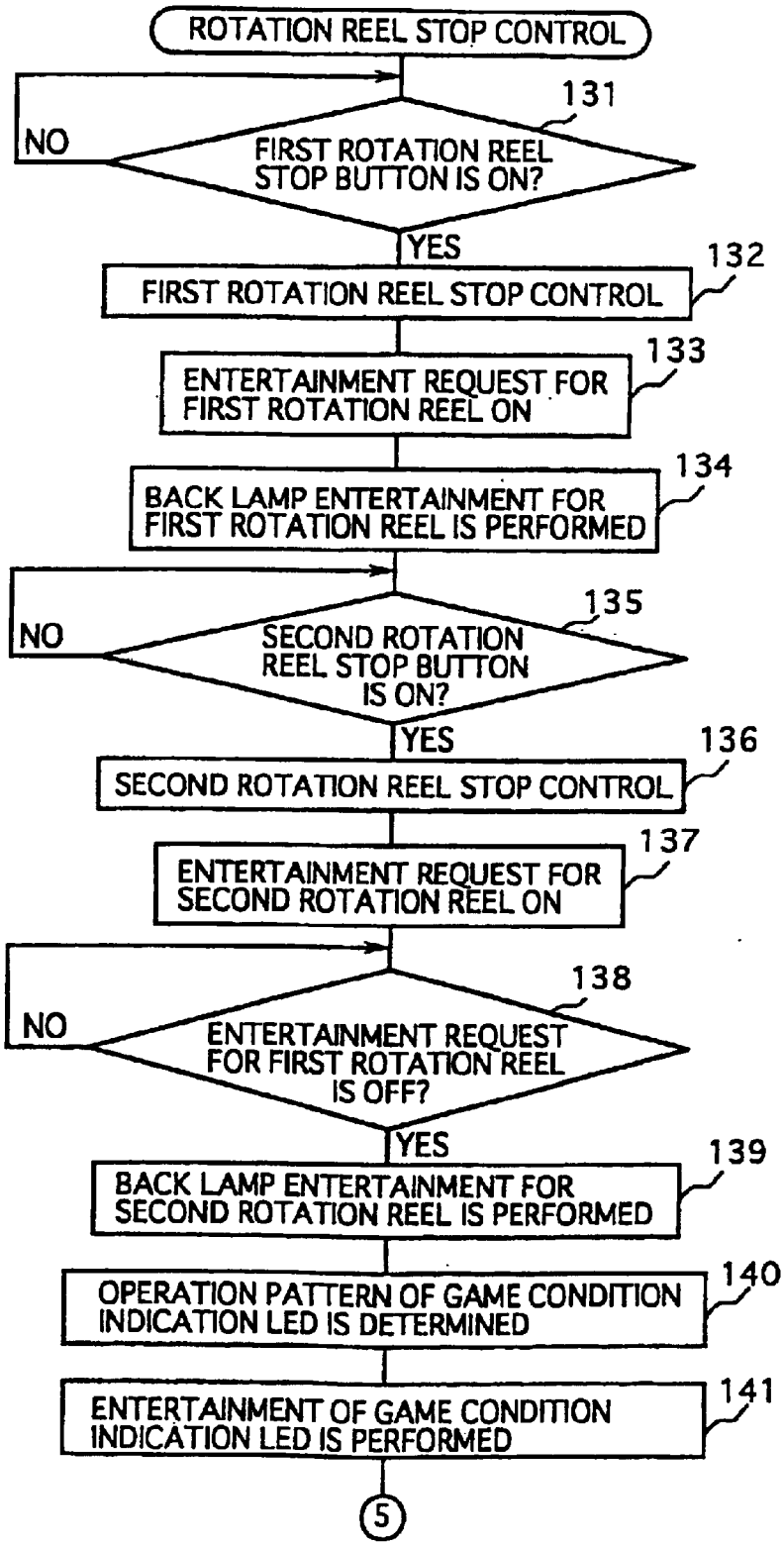
FIG. 45 is a first flow chart partly showing the process of controlling the rotation and stop of the rotation reels shown in FIG. 43.
Figure 46:
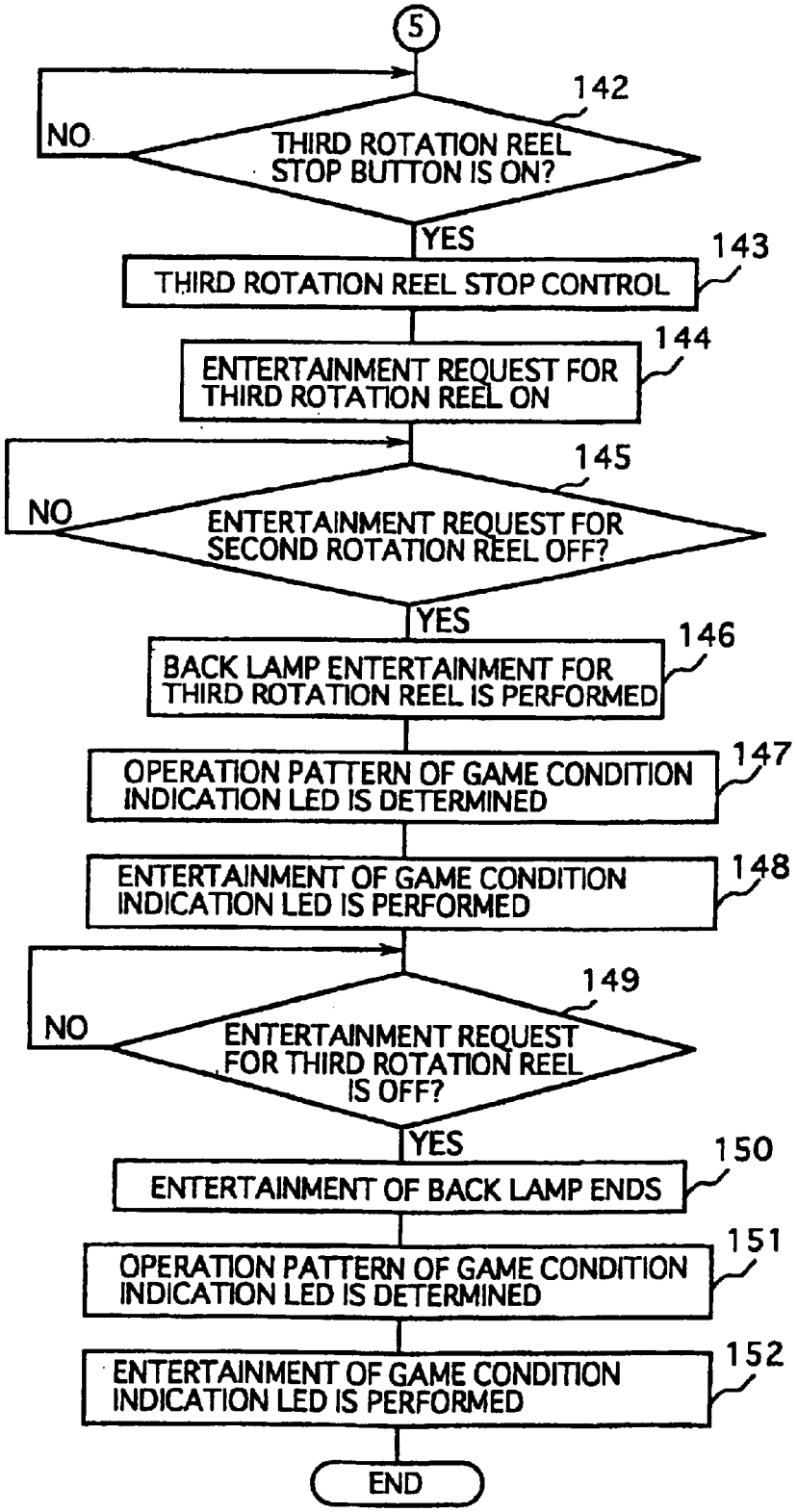
FIG. 46 is a second flow chart partly showing the process of controlling the rotation and stop of the rotation reels shown in FIG. 43, FIGS. 47(*a*) to 47(*c*) are tables showing the relationships between the rotation reels and the symbol cords assigned to the rotation reels and read respectively by the processing unit forming part of the slot machine according to the present invention.

In the step S112, the first, second and third rotation reels 3, 4, and 5 are driven to rotate by the stepping motors 55 and start rotating simultaneously (S112). The step S112 goes forward to the step S113 wherein the stop control operation for each of the rotation reels 3, 4, and 5 is performed (rotation reel stop control process) (S113). Referring to FIGS. 45 and 46 of the drawings, the rotation reel stop control will be described in details hereinafter.

As described hereinbefore, the operation of each of the stop buttons 16 to 18 is detected by the CPU 31 through the rotation reel stop signal circuit 45. In the step S131, the judgment is made by the CPU 31 upon whether the stop button 16 of the first rotation reel 3 is turned on or not (see FIG. 45, S131). If the judgment is made by the CPU 31 that the stop button 16 is turned on, the step S131 goes forward to the step S132 wherein the stop control process of the first rotation reel 3 is performed (S132). In other words, the number of drive pulses supplied to the stepping motor 55 of the first rotation reel 3 is read from the RAM 33 when the stop button 16 of the first rotation reel 3 is operated by the game player, and the current position of the first rotation reel 3 is detected. Then, with reference to the detected position of the first rotation reel 3, three symbol marks appeared in the observation window 6 are determined on the basis of the symbol mark table (see FIG. 7) using symbol codes.

At this time, if the big prize winning request flag is set, the judgment is made by the CPU 31 upon whether any of the symbol marks constituting the big prize winning state is located on any of the effective prize winning lines of the observation window 6 or not. Also, if the medium prize or small prize winning request flag is set, the judgment is made by the CPU 31 upon whether any of the symbol marks constituting the medium prize or small prize winning state is located on any of the effective prize winning lines of the observation window 6 in the same manner. If the judgment is made by the CPU 31 that the target symbol mark constituting the concerned prize winning state is located on any of the effective prize winning lines, the CPU31 immediately stops the first rotation reel 3 from rotating. There is provided another alternative to the aforesaid method in consideration of the fact that the first rotation reel 3 may fail to be immediately stopped from rotating, i.e., the judgment may be made by the CPU 31 upon whether any of the symbol marks constituting the prize winning state is located up to a couple of symbol marks prior to the prize winning line or not.

If the judgment is made by the CPU 31 that the target symbol mark constituting the concerned prize winning state is not located on any of the effective prize winning lines of the observation window 6, each of symbol marks to be appeared on any of the effective prize winning lines is checked for every rotation angle of the first rotation reel 3 up to four symbol marks. If the judgment is made by the CPU 31 that the target symbol mark representative of the concerned prize winning request flag is located up to four symbol marks, the CPU is operated to control shift and display means so that the first rotation reel 3 is rotated for the number of symbol marks, and then stopped from rotating. The shift control process is performed in the same manner when the stop control operation is performed for the second and third rotation reels 4 and 5.

In the step S133, the entertainment request for the first rotation reel is turned on at the time shown in FIG. 30 (*m*) (S133). The step S133 proceeds to the step S134 wherein the entertainment process for the first rotation reel back lamps (1) to (9) is performed in accordance with the reel lamp operation pattern determined in the step S110 (S134). The entertainment process is performed in accordance with any of the operation patterns 0 to 4 shown in FIGS. 25 to 28 as described hereinbefore. In this step, for instance, if the game start sound/rotation reel lamp operation group number 2 is selected from the variation value of "−2" and the "bells" prize winning flag, the light-on/off of each of the back lamps (1) to (9) is controlled in accordance with the rotation reel lamp operation pattern 2 as shown in FIGS. 30 (*a*) to (*i*) when the first rotation reel is stopped from rotating. In other words, all the back lamps (1) to (9) are turned off as described hereinbefore.

In the step S135, the judgment is made by the CPU 31 upon whether the stop button 17 of the second rotation reel 4 is turned on or not (S135). If the judgment is made by the CPU 31 that the stop button 17 is turned on, the step S136 goes forwards to the step S136 wherein the stop control process is performed for the second rotation reel 4 (S136). At this time, with the second rotation reel 4 rotating, every possible combination of symbol marks of symbol codes 0 to 20 of the second rotation reel 4 which may appear on the center prize winning linen L1 of the observation window 7 and the symbol marks of the first rotation reel 3 stopped on the effective prize winning line is read from the RAM 33 using the symbol code. On the other hand, for the third rotation reel 5, a rotation code indicating that the rotation reel is rotating is read from the RAM 33. The second rotation reel 4 is assumed to be stopped from rotating by means of the stop control operation, thereby resulting that the anticipated symbol codes are read from RAM 33 in place of the rotation code, although the second rotation reel 4 is still rotating.

When every possible combination of symbol codes is read from the RAM 33, the possible prize winning state corresponding to each of the combinations of symbol codes is sequentially judged on the basis of the aforesaid winning symbol combination table. For instance, if the first rotation reel 3 is stopped from rotating as shown in FIG. 47(*a*), each of the combination patterns of 21 possible stop positions of the second rotation reel 4 and the known position of the first rotation reel 3 is sequentially checked. If the second rotation reel 4 is stopped from rotating with the result that the symbol mark of the code number "5" is displayed in the middle of the observation window 7, the respective combinations of symbol codes appeared on each of the effective prize winning line L1, L2A, L2B, L3A, and L3B are shown in FIG. 47 (*c*).

In FIG. 47(*c*), although the position of the third rotation reel 5 is shown with the rotation code, two possible prize winning states, i.e., the big prize winning state of "A-A-A" on the effective prize winning line L2A and the small prize winning state of "E-E-E" on the effective prize winning line L2B can be anticipated. As a result, for the code number "5" of the second rotation reel 4, expectation flags of the big prize winning state and the small prize winning state are set as shown in FIG. 48. Presence or absence of such expectation flag is checked for all the possible code numbers of the second rotation reel 4 and then concerned data is stored in the RAM 33.

When the second rotation reel 4 is stopped from rotating by means of the stop control operation, the expectation flags stored in the RAM 33 are referred to. In other words, when the operation of the stop button 17 of the second rotation reel 4 by the game player is detected, all the expectation flags related to the code numbers of the second rotation reel 4 is referred to. If the big prize winning state is expected, the second rotation reel 4 is stopped from rotating by means of the stop control operation so that the set of symbol marks representative of the big prize winning state are stopped and displayed on the effective prize winning line.

When the aforesaid rotation reel stop control process is completed, the step S136 proceeds to the step S137, wherein the entertainment request for the second rotation reel is turned on at the time shown in FIG. 30 (*n*) (S137). The step S137 proceeds to the step S138 wherein the judgment is made by the CPU 31 upon whether the entertainment request for the first rotation reel turned on in the step S133 is turned off or not, i.e., the entertainment operation by means of the rotation reel lamp operation is completed or not when the first rotation reel is stopped from rotating (S138). If the judgment is made by the CPU 31 that the entertainment request for the first rotation reel is not turned off, a time waiting process is performed to wait until the entertainment request is turned off.

If the judgment is made by the CPU 31 that the entertainment request for the first rotation reel is turned off, the step S138 goes forward to the step S139 wherein the entertainment process for the second rotation reel back lamps (1) to (9) is performed (S139). In the aforesaid case when the game start sound/rotation reel lamp operation group number 2 is selected from the variation value of "−2" and the "bells" prize winning flag, the light-on/off of each of the back lamps (1) to (9) is controlled in accordance with the rotation reel lamp operation pattern 1 as shown in FIGS. 30 (*a*) to (*i*) when the second rotation reel is stopped from rotating. In other words, the back lamps (1), (4) and (7) of the first rotation reel 3 move downward once (−1) as described hereinbefore.

In the step S140, the entertainment operation pattern of the game condition indication LED 25 is determined (S140). As described hereinbefore, the operation pattern is determined on the basis of the value of the "total of rotation reel lamp operation pattern −2", which is incremented by the "rotation reel lamp operation pattern −2" each time when the rotation reel lamp operation is completed, in reference to the game condition indication LED operation table shown in FIG. 31(*a*). In the step S141, the entertainment process of the game condition indication LED 25 is performed at the time shown in FIG. 30 (*k*) in accordance with the entertainment operation pattern determined in the step S140 (S141). The entertainment process is performed in accordance with any of the operation patterns 0 to 4 shown in FIGS. 25 to 28 as described hereinbefore.

In the step S142, the judgment is made by the CPU 31 upon whether the stop button 18 of the third rotation reel 5 is turned on or not (S142). If the judgment is made by the CPU 31 that the stop button 18 is turned on, the step S142 goes forward to the step S143 wherein the stop control process is performed for the third rotation reel 5 (S143). By this time, the first and second rotation reels 3, 4 have already been stopped from rotating, thereby making it possible for the combination of their symbol marks to be known. Every possible combination of symbol marks of symbol codes 0 to 20 of the third rotation reel 5 and the known set of the remaining symbol marks of the first and second rotation reels 3 and 4 is checked and the respective prize winning state corresponding to each of the aforesaid combination is sequentially judged. A prize winning expectation flag is set in the same manner as shown in FIG. 48.

When the stop button 18 of the third rotation reel 5 is operated by the game player, the prize winning expectation flag is referred to. At this time, if the big prize winning expectation flag is set, the third rotation reel 5 is stopped from rotating by means of the stop control operation on the basis of the aforesaid expectation flag so that the set of symbol marks representative of the big prize winning state are stopped and displayed on the effective prize winning line. The stop control operation is operated to stop the third rotation reel 5 from rotating so that the set of the symbol marks representative of the target prize winning expectation flag could be stopped and displayed and, in addition, the set of the symbol marks representative of the prize winning state which the target expectation flag does not indicate will not be stopped and displayed.

As a result of the first, second and third rotation reel stop control processes performed in the steps S132, S136, and S142, each of the first, second and third rotation reels is controlled so that the set of symbol marks representative of any of the prize winning states will not be stopped and displayed on any of the prize winning lines if the prize winning flag indicates "no-prize". In addition, as a result of the aforesaid rotation reel stop control process, each of the first, second and third rotation reels is controlled so that the set of symbol marks representative of the "bells" or "plums" prize winning states will be stopped and displayed on any of the prize winning lines if the prize winning flag indicates "bells" or "plums". Furthermore, as a result of the aforesaid rotation reel stop control process, each of the first, second and third rotation reels is controlled so that the set of symbol marks of "7" or particular character symbol will be stopped and displayed in line on any of the prize winning lines if the prize winning flag indicates "RB" or "BB".

When the aforesaid rotation reel stop control process is completed, the step S143 goes forward to the step S144, wherein the entertainment request for the third rotation reel is turned on at the time shown in FIG. 30 (*o*) (S144). The step S144 proceeds to the step S145 wherein the judgment is made by the CPU 31 upon whether the entertainment request for the second rotation reel turned on in the step S137 is turned off or not, i.e., the entertainment operation by means of the rotation reel lamp operation is completed or not when the second rotation reel is stopped from rotating (S145). If the judgment is made by the CPU 31 that the entertainment request for the second rotation reel is not turned off, a time waiting process is performed to wait until the entertainment request is turned off.

If the judgment is made by the CPU 31 that the entertainment request for the second rotation reel is turned off, the step S145 goes forward to the step S146 wherein the entertainment process for the third rotation reel back lamps (1) to (9) is performed (S146). In the aforesaid case when the game start sound/rotation reel lamp operation group number 2 is selected from the variation value of "−2" and the "bells" prize winning flag, the light-on/off of each of the back lamps (1) to (9) is controlled in accordance with the rotation reel lamp operation pattern 1 as shown in FIGS. 30 (*a*) to (*i*) when the third rotation reel is stopped from rotating. In other words, the back lamps (1), (4) and (7) of the third rotation reel 3 move downward once (−1) as described hereinbefore.

In the step S147, the entertainment operation pattern of the game condition indication LED 25 is determined (S147). As described hereinbefore, the operation pattern is determined on the basis of the value of the "total of rotation reel lamp operation pattern −2", which is incremented by the "rotation reel lamp operation pattern −2" each time when the rotation reel lamp operation is completed. The step S147 proceeds to the step S148 wherein the entertainment process of the game condition indication LED 25 is performed at the time shown in FIG. 30 (*k*) in accordance with the entertainment operation pattern determined in the step S147 (S148).

The step S148 proceeds to the step S149 wherein the judgment is made by the CPU 31 upon whether the entertainment request for the third rotation reel turned on in the step S144 is turned off or not, i.e., the entertainment operation by means of the rotation reel lamp operation is completed or not when the third rotation reel is stopped from rotating (S149). If the judgment is made by the CPU 31 that the entertainment request for the third rotation reel is not turned off, a time waiting process is performed to wait until the entertainment request is turned off.

If the judgment is made by the CPU 31 that the entertainment request for the third rotation reel is turned off, the step S149 goes forward to the step S150 wherein the entertainment process for the third rotation reel back lamps (1) to (9) started in the step S146 is completed (S150). In the step S151, the entertainment operation pattern of the game condition indication LED 25 is determined (S151). As described hereinbefore, the operation pattern is determined on the basis of the value of the "total of rotation reel lamp operation pattern −2", which is incremented by the "rotation reel lamp operation pattern −2" each time when the rotation reel lamp operation is completed. The step S151 proceeds to the step S152 wherein the entertainment process of the game condition indication LED 25 is performed at the time shown in FIG. 30 (*k*) in accordance with the entertainment operation pattern determined in the step S151 (S152). The entertainment process is completed at the time when the first game medal is inserted for the subsequent game in the aforesaid step S103.

Figure 43:
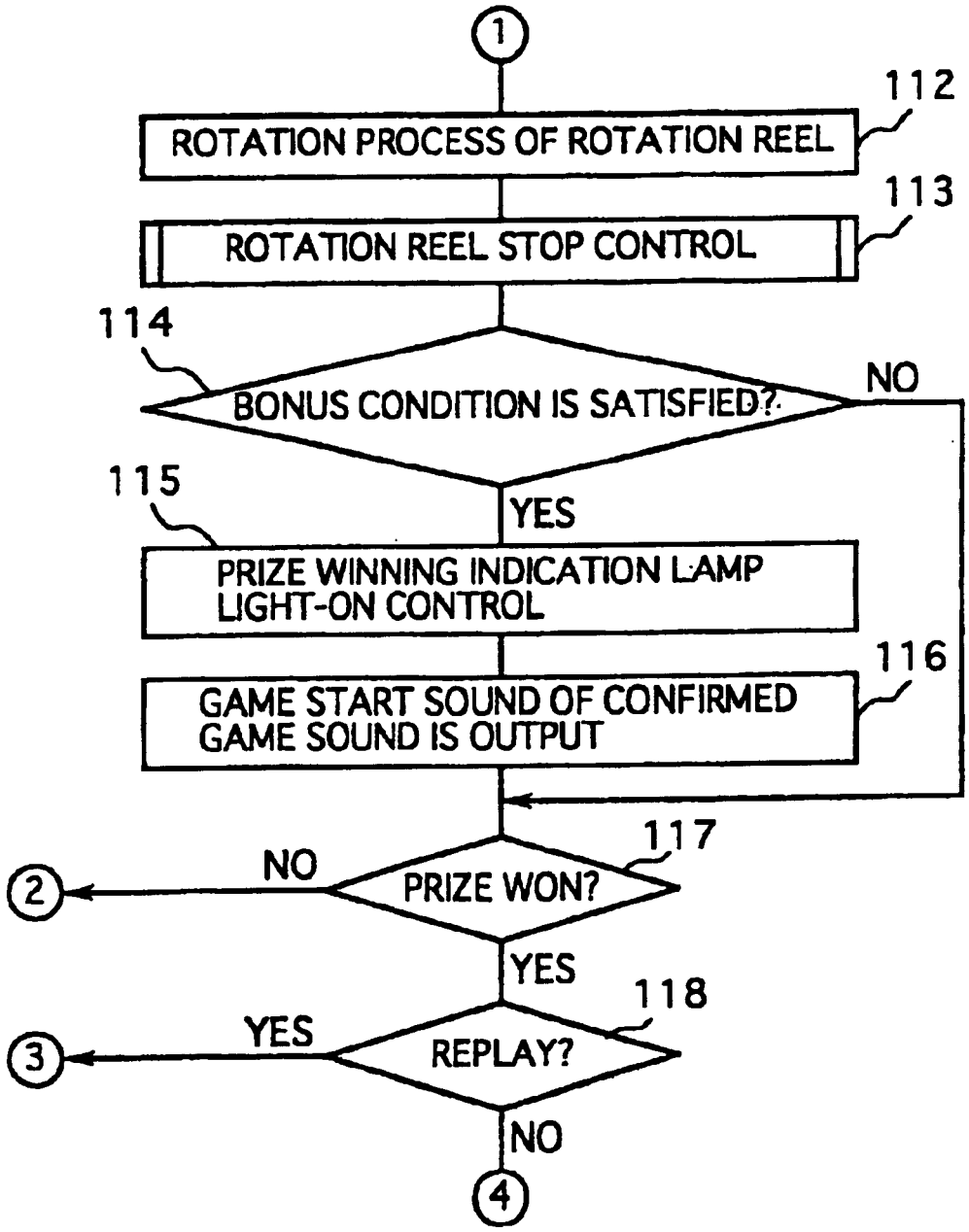
FIG. 43 is a second flow chart partly showing the process of the processing unit forming part of the slot machine according to the present invention.

The rotation reel stop control process in the step S113 shown in FIG. 43 is thus completed. Then, the step S113 proceeds to the step S114 wherein the judgment is made by the CPU 31 upon whether the bonus condition is satisfied or not (S114). As described hereinbefore, the bonus condition is satisfied when the specified combination of "the game start sound and rotation reel operation" is performed according to the table shown in FIG. 37 and the specified game sounds 4 and 5 are to be output in the subsequent game. If the bonus condition is satisfied, the step S114 goes forward to the S115 wherein the prize winning indication lamp 24 lights on at the time of the confirmation operation as shown in one of FIGS. 38 and 40 according to the satisfied bonus condition (S115). Then, the step S115 goes forward to the S116 wherein the start sound of confirmed game sound is output once from the speaker 39 at the time shown in one of FIGS. 38 and 40 according to the satisfied bonus condition (S116). The step S116 proceeds to the step S117.

Also, if the judgment is made by the CPU 31 that the bonus condition is not satisfied, the step S114 goes forward to the step S117 wherein the judgment is made by the CPU 31 upon whether the set of symbol marks stopped and displayed on the prize winning line correspond to the determined prize winning state or not, with reference to the winning symbol combination table (S117). The stop positions of the rotation reels are not determined by the rotation reel stop control operation alone. The operation time of each of the stop buttons 16 to 18 by the game player also affects the stop positions of the rotation reels. This means that although the prize winning flag may be set as a result of the lottery operation using random numbers, if each of the stoop buttons 16 to 18 is not operated at the appropriate time, the set of symbol marks representative of the determined prize winning state will not be stopped and displayed on the prize winning line, thus resulting in no prize. As described hereinbefore, the shift control operation can be performed up to four symbol marks. This leads to the fact that the prize winning state cannot be won if the target symbol marks representative of the concerned prize winning state is not located within the four symbol marks.

If the judgment is made by the CPU 31 that the set of symbol marks stopped and displayed on the prize winning line do not correspond to the determined prize winning state, i.e. the judgment is made by the CPU 31 that no prize is won in the step S117, the step S117 goes back to the S101. Otherwise, the step S117 goes forward to the S118 wherein the judgment is made by the CPU 31 upon whether the "replay game" prize is won or not. If the judgment is made by the CPU 31 that the "replay game" prize is won, the step S118 goes forward to the step S107 of waiting for the operation of the start lever 15 (S118). Otherwise, the step S118 goes forward to the S119 wherein the CPU 31 is operated to control the hopper drive circuit 41 with the result that the predetermined number of game medals is paid out to the medal catch plate 20 (see FIG. 44, step S119). The check process of the bonus condition performed in the steps 114, 115 and 116 in the flowchart can be done after the rotation reel stop control process (S113). The check process also can be done after the medal payout process of the step S119.

For instance, with the "bells" prize of the small prize winning won, 6 game meals, with the "plums" prize of the small size winning won, 8 game medals are paid out. With the "BB" or "RB" prize of the big prize winning won, 15 game medals are paid out.

Then the step S119 goes forward to the step S120 wherein the judgment is made by the CPU 31 upon whether the BB game condition is won or not (S120). If the judgment is made by the CPU 31 that the BB game condition is won, the step S120 goes forward to the S121 wherein the game condition is changed over to the BB game condition and then the game is played under the BB game condition (S121). Otherwise, the step S120 goes forward to the S122 wherein the judgment is made by the CPU 31 upon whether the RB game condition is won or not (S122). If the judgment is made by the CPU 31 that the RB game condition is won, the step S122 proceeds to the S123 wherein the game condition is changed over to the RB game condition and then the game is played under the RB game condition (S123). When the BB or RB game condition is over, the prize winning indication lamp 24 lights off at the time shown in FIG. 41 (S142). Then, the slot machine continues to operate in the process as described hereinbefore.

In the embodiment according to the present invention, as described hereinbefore, the subsequent game sound 1 to 5 is selected in the current game by the subsequent notifying state determining means on the basis of the current game sound 1 to 5 in the step S109. One of the game sounds 1 to 5 selected for the subsequent game sound by the notifying state determining means in the previous game is notified as a current game sound in the step 106. This leads to the fact that a notification notified in the current game (hereinafter simply referred to as "current notification") can be associated with a notification to be notified in the subsequent game (hereinafter simply referred to as "subsequent notification"). In the conventional game machine, in which the subsequent notification is notified independent from the current notification, the contents of the current notification is interrupted when the subsequent notification starts. On the other hand, the game machine of the embodiment is improved in that the contents of the current notification is related with that of the subsequent notification, thereby preventing the current notification from being ended in the current game alone. The game machine of the embodiment thus enhances the fun of the games thereby enabling to afford the game players extensive amusement of the slot machine 1.

In addition to the notifying means for generating game sounds 1 to 5, the game machine of the embodiment comprises the second notifying means collectively constituted by the rotation reel back lamps (1) to (9), the game condition indication LED 25, the sound generation means for generating the game start sound 1 or 2. The notifying state in the current game (i.e., current notifying state) by the second notifying means is determined by the second notifying state determining means on the basis of the notifying state to be notified in the subsequent game (i.e., subsequent notifying state) in the step 110. As a consequence, the notification in the current game is notified additionally by the second notifying means in the notifying state associated with the game sound 1 to 5 which has already been determined to be output in the subsequent game sound. The game machine of the embodiment thus provides various kinds of notifying contents, thereby enabling to afford the game players extensive amusement.

In the embodiment, as described hereinbefore, the game player can recognize that the RB or BB inner winning confirmation is set by hearing the game sound 4 or 5 output by the notifying means. This leads to the fact that even game players with no experience of judging whether the RB or BB prize winning flag is set or not, i.e., "li-zhi" or not by means of careful observation of sets of symbol marks appeared in the observation windows can recognize "li-zhi by simply hearing the game control sounds 4 and 5, thus enabling the game machine to attract the game players who are reluctant to play game machines with rotation reels.

In addition to the prize winning indication lamp 24, the game player can recognize that the RB or BB inner winning state is generated by hearing the game sound 4 or 5. Accordingly, the slot machine 1 of the embodiment makes it possible for the game players to easily recognize the RB or BB inner winning state is generated in various manners.

As stated hereinbefore, the fact that RB or BB inner winning confirmation state is generated does not always cause the game sound 4 or 5 to be output as the subsequent game sound. The game sound 1, 2, or 3 may be output as the sequent game sound as well. This means that the inner winning confirmation state is notified to the game player with the corresponding probability. In other words, the RB or BB inner winning confirmation state is sometimes notified to the game player and at other times not, resulting in the fact that the game players look forward to the game sound 4 or 5 and the joy of the game player is increased when the game sound 4 or 5 is output.

The game machine according to the present invention is exemplified by, but not limited to, the slot machine in the aforesaid embodiment. In another embodiment, the present invention may be applied to another game machine including pinball machine such as "pachinko" and other amusement machines.

The present invention can be applied to a "pachinko" machine in a manner to replace the sequential flow in the embodiment of the operation process for operating the start lever device, the sampling process for sampling a random number to determine the prize winning state, and the start process for rotating the rotation reels with a flow of the "pachinko" machine of a prize winning process for entering "pachinko" balls into specified prize winning holes, a sampling process for sampling a random number to determine the prize winning state, and a start process for rotating rotation reels mounted in the "pachinko" machine. The "pachinko" machine comprises variable prize winning means which includes ball receiving parts such as "attacker" and "tulip" formed with holes to have ball received therein. The variable prize winning means is designed to pay out a plurality of "pachinko" balls to the game player when a "pachinko" ball enters therein. In the aforesaid embodiment of the slot machine, game medals are paid out when the set of symbol marks representative of predetermined prize winning state are stopped and displayed on the prize winning line. In another embodiment of the "pachinko", the aforesaid variable prize winning means may be adjusted so that many "pachinko" balls are awarded to the game player if specified conditions are satisfied.

In the embodiment according to the present invention, as described hereinbefore, the notifying state to be notified in the subsequent games, i.e., the subsequent notifying state is selected on the basis of the notifying state being notified in the current game, i.e., current notifying state, and thus the notification notified in the current game will be associated with the notification to be notified in the subsequent game. This leads to the fact that the notification notified in the current game is prevented from being not ended in the current game alone. In stead, the notification to be notified in the subsequent game is associated with the notification notified in the current game. The game machine of the embodiment thus enhances the fun of the games.

The notifying state in the current game by the second notifying means is determined by the second notifying state determining means on the basis of the notifying state to be notified in the subsequent games. As a consequence, the notification in the current game is notified additionally by the second notifying means in the notifying state associated with the notification to be notified in the subsequent games which has already been determined. The game machine of the embodiment thus provides various kinds of notifying contents, thereby enabling to afford the game players extensive amusement.

In the embodiment, as described hereinbefore, the notifying means serves to notify the game player of the specified prize winning state which has been determined by the lottery operation run in the machine. This leads to the fact that the game player can easily recognize that the specified prize winning state generated in the machine in various manners. Particularly, the slot machine of the embodiment enables the game player to operate the stop buttons so as to stop and display the target set of symbol marks representative of the specified prize winning state. In general, the big prize winning flag of the slot machine remains until the set of symbol marks representative of the big prize winning state are stopped and displayed on the prize winning line. This leads to the fact that the game player may lose game medals in the period while the big prize winning flag is set. On the other hand, the game machine of the embodiment may sometimes notify the game players of specified prize winning state of which the corresponding prize winning flag is set and at other times not, thereby resulting in the fact that the game players look forward to the notification of the specified prize winning state and the joy of the game player is enhanced when the notification is finally received.

While the subject invention has been described with relation to the preferred embodiments, various modifications and adaptations thereof will now be apparent to those skilled in the art as far as such modifications and adaptations fall within the scope of the appended claims intended to be covered thereby.

What is claimed is:

1. A game machine, comprising:

shift and display means for shifting and displaying a plurality of rows each having a plurality of symbol marks thereon;

prize winning state determining means for determining a prize winning state based on random number lottery;

stop control means for controlling the stop of said shift and display means to have a set of symbol marks shifted and displayed on the basis of said prize winning state determined by said prize winning state determining means;

notifying means for notifying a game player of information in game states including a current game state and subsequent game states following said current game state, while the game player is enjoying games including a current game and subsequent games following said current game, the information in the current game state being information about the game currently being played;

said notifying means notifying the game player of information in the current game state while the current game is being played before the shift and display means is stopped at the end of the current game to have a set of symbols displayed; and subsequent game state determining means for determining and selecting in advance said subsequent notifying states in said current game on the basis of said current game state to be informed by said notifying means, second notifying means provided separately from said first mentioned notifying means to notify a game player of information in the current notifying game state; and second game state determining means for determining and selecting in advance said current game states on the basis of said subsequent game states determined by said subsequent game state determining means.

2. A game machine as set forth in claim 1, formed with a medal inserting slot, and in which said notifying means is operative to notify the game player of said game state determined by said subsequent game state determining means when said current or subsequent game starts with a game medium inserted in said medal inserting slot.

3. A game machine as set forth in claim 1, in which the information notified by said notifying means is correspondent to specified prize winning state determined by said prize winning state determining means.

4. A game machine as set forth in claim 3, in which said notifying means is operative to notify the game player of said game state corresponding to said prize winning state at a predetermined probability.

5. A game machine as set forth in claim 3, in which said prize winning state is any of big winning state or medium winning state.

6. A game machine as set forth in claim 1, in which said game machine is a slot machine or a pinball machine.

7. A game machine, comprising:

shift and display means for shifting and displaying a plurality of rows each having a plurality of symbol marks thereon;

prize winning state determining means for determining a prize winning state based on random number lottery;

stop control means for controlling the stop of said shift and display means to have a set of symbol marks shifted and displayed on the basis of said prize winning state determined by said prize winning state determining means;

notifying means for notifying a game player of information in game states including a current game state and subsequent game states following said current game state, while the game player is enjoying games including a current game and subsequent games following said current game, the information in the current game state being information about the game currently being played;

said notifying means notifying the game player of information in the current game state while the current game is being played before the shift and display means is stopped at the end of the current game to have a set of symbols displayed; and subsequent game state determining means for determining and selecting in advance said subsequent notifying states in said current game on the basis of said current game state to be informed by said notifying means, in which when said current game state in said current game is identical to said subsequent game states in said subsequent games, said notifying means continues to notify the game player of said identical game state without interruption.

8. A game machine, comprising:

shift and display means for shifting and displaying a plurality of rows each having a plurality of symbol marks thereon;

prize winning state determining means for determining a prize winning state based on random number lottery;

stop control means for controlling the stop of said shift and display means to have a set of symbol marks shifted and displayed on the basis of said prize winning state determined by said prize winning state determining means;

notifying means for notifying a game player of information in game states including a current game state and subsequent game states following said current game state, while the game player is enjoying games including a current game and subsequent games following said current game, the information in the current game state being information about the game currently being played;

said notifying means notifying the game player of information in the current game state while the current game is being played before the shift and display means is stopped at the end of the current game to have a set of symbols displayed; and subsequent game state determining means for determining and selecting in advance said subsequent notifying states in said current game on the basis of said current game state to be informed by said notifying means, in which said game states are respectively indicated by numbers, which further comprises storage means for storing variation values each showing relationship between said current game state and said subsequent game state, whereby said subsequent game state determining means is operative to determine and select said subsequent game states with reference to a variation value selected by a lottery operation from among said variation values stored in said storage means.

* * * * *